US011617448B2

(12) United States Patent
Leng

(10) Patent No.: US 11,617,448 B2
(45) Date of Patent: Apr. 4, 2023

(54) BED FRAME

(71) Applicant: NEW-TEC INTEGRATION (XIAMEN) CO., LTD., Fujian (CN)

(72) Inventor: Luhao Leng, Fujian (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 307 days.

(21) Appl. No.: 16/993,368

(22) Filed: Aug. 14, 2020

(65) Prior Publication Data

US 2021/0045537 A1 Feb. 18, 2021

(30) Foreign Application Priority Data

Aug. 14, 2019 (CN) ..... 201910750491.4

(51) Int. Cl.
*A47C 19/12* (2006.01)
*A47C 19/02* (2006.01)

(52) U.S. Cl.
CPC ..... *A47C 19/126* (2013.01); *A47C 19/027* (2013.01)

(58) Field of Classification Search
CPC ..... A47C 19/126; A47C 19/124; A47C 19/04; A47C 19/14; A47C 19/12; A47C 19/021; A47C 19/022; A47C 19/024; A47C 19/122; A47D 7/01; F16H 3/08; F16H 19/001; F16H 19/04; A47B 3/0913; A47B 3/0915
See application file for complete search history.

(56) References Cited

U.S. PATENT DOCUMENTS 2,550,224 A * 4/1951 Clerc ..... A47C 19/04 5/310
2,590,129 A * 3/1952 Sawaya ..... A47C 19/126 5/174
2,666,931 A * 1/1954 Clerc ..... A47C 19/04 248/188.91
3,744,066 A * 7/1973 Falivene ..... A47C 19/04 5/116

(Continued)

OTHER PUBLICATIONS

Noah Megatron, available inAmazon.com, date first available Nov. 20, 2018 [online], retrieved Dec. 16, 2021 from URL: https://www.amazon.com/dp/b084ZQRPLC/ (Year: 2018).

(Continued)

*Primary Examiner* — Peter M. Cuomo
*Assistant Examiner* — Alison N Labarge
(74) *Attorney, Agent, or Firm* — Perkins Coie LLP

(57) ABSTRACT

A bed frame has a left longitudinal support bar, a right longitudinal support bar and an intermediate longitudinal support bar, two sliding sleeves slidably disposed on the intermediate longitudinal support bar, wherein each of the sliding sleeve is provided with a bracket. The bed frame further comprises four connecting rods connected between the left longitudinal support bar or right longitudinal support bar and the intermediate longitudinal support rod, one end of each of the connecting rods is pivotally connected to the left or right longitudinal support bar, the other end is pivotally connected with the bracket so that the end of the connecting rod mounted on the bracket moves along with the sliding sleeve. The bed frame is simple and easy to fold and un-fold, while providing improved strength and stability.

39 Claims, 18 Drawing Sheets

(56) References Cited

U.S. PATENT DOCUMENTS

| | | | | |
|---|---|---|---|---|
| 5,502,852 | A * | 4/1996 | Fredman | A47C 19/024 248/188.4 |
| 6,415,465 | B1 | 7/2002 | Harrow | |
| 8,132,517 | B2 * | 3/2012 | Leng | A47C 4/22 248/439 |
| D885,078 | S | 5/2020 | Liang et al. | |
| D917,193 | S | 4/2021 | Shen | |
| D917,195 | S | 4/2021 | Shen | |
| 11,006,763 | B1 | 5/2021 | Oh | |
| 2002/0059678 | A1 * | 5/2002 | Hernandez | A47C 19/12 5/200.1 |
| 2009/0133191 | A1 | 5/2009 | Harrow | |
| 2012/0222216 | A1 | 9/2012 | Jin | |
| 2012/0246826 | A1 | 10/2012 | Jin | |
| 2012/0304380 | A1 * | 12/2012 | Jin | A47C 19/126 5/400 |
| 2015/0143630 | A1 | 5/2015 | Harrow | |
| 2018/0045235 | A1 | 2/2018 | Oh | |
| 2018/0125255 | A1 * | 5/2018 | Jin | A47C 19/024 |
| 2018/0271296 | A1 * | 9/2018 | Harrow | A47C 19/025 |
| 2018/0352966 | A1 * | 12/2018 | Bitzounis | A47C 5/10 |
| 2018/0372138 | A1 | 12/2018 | Li | |
| 2020/0359803 | A1 | 11/2020 | Choi | |
| 2021/0353070 | A1 | 11/2021 | Chen et al. | |

OTHER PUBLICATIONS

Zinus Michelle Compack Adjustable Steel Bed Frame, available in Amazon.com, date first available Sep. 17, 2021 [online], retrieved on Dec. 15, 2021 from URL:https://www.amazon.com/Zinus-Compack-Adjustable-Spring-Mattress/dp/B015IHMK5C/ (Year: 2021).

* cited by examiner

BED FRAME

CROSS-REFERENCE TO RELATED APPLICATIONS

This application claims the benefit of Chinese Patent Application No. 201910750491.4, filed Aug. 14, 2019, which is incorporated herein by reference in its entirety.

FIELD OF THE DISCLOSURE

The present disclosure relates to the field of furniture, and in particular to a bed frame.

BACKGROUND OF THE DISCLOSURE

Foldable beds have become popular furniture products. However, the folding function of the existing foldable beds is usually not ideal, and they may lack sufficient rigidity and stability. Further, since existing bed frames are sold as a whole after the completion of assembly at the factory, consumers can use and store the bed frames only by folding and unfolding the bed frames, but cannot detach or disassemble elements of the bed frame. Thus, existing folding bed frames tend to be bulky, requiring excessive storage space and transportation costs.

Accordingly, improved folding bed frames are needed.

SUMMARY OF THE DISCLOSURE

A main object of the present disclosure is to provide a bed frame enabling a user to quickly and effectively fold the bed frame. The space occupied by the collapsed bed frame is small. Further, the folding process is relatively simple and easy to implement. Furthermore, the bed frame exhibits larger strength and better stability, so that the bed frame can bear a larger weight in either the deployed state or collapsed state, and thus can satisfy multiple demands of the users.

An aspect of the present disclosure provides a bed frame, comprising:

a left longitudinal support bar and a right longitudinal support bar which are located at a left side and a right side of the bed frame respectively and extend in a longitudinal direction of the bed frame;

an intermediate longitudinal support bar disposed between the left longitudinal support bar and the right longitudinal support bar and extending in the longitudinal direction of the bed frame, wherein the bed frame further comprises:

two spaced-apart sliding sleeves slidably disposed on the intermediate longitudinal support bar, wherein each of the sliding sleeves is provided with a bracket; and four connecting rods comprising two left connecting rods extending between the left longitudinal support bar and the intermediate longitudinal support bar and two right connecting rods extending between the right longitudinal support bar and the intermediate longitudinal support bar, wherein one end of each of the connecting rods is pivotally attached to one end of the left longitudinal support bar or the right longitudinal support bar, and the other end of the each of the connecting rods is pivotally attached to the bracket of a corresponding sliding sleeve, wherein each of the connecting rods is configured so that its end mounted on the bracket moves along with the corresponding sliding sleeve when the sliding sleeve slides along the intermediate longitudinal support bar, thereby driving the connecting rod to move on a horizontal plane, as a result of which the bed frame is formed in a deployed state or a collapsed state.

According to an embodiment of the present invention, when the sliding sleeves are sliding toward each other along the intermediate longitudinal support bar, the bed frame is gradually folded until the bed frame gets into the collapsed state in which the left longitudinal support bar, the right longitudinal support bar, the intermediate longitudinal support bar and the connecting rods abut against one another. When the sliding sleeves are sliding away from each other along the intermediate longitudinal support bar, the bed frame is gradually deployed until the bed frame gets into a developed state in which the respective connecting rods are perpendicular to the left longitudinal support bar, the right longitudinal support bar and the intermediate longitudinal support bar, respectively.

According to another embodiment of the present invention, the intermediate longitudinal support bar is disposed with pin holes at positions close to its end portions and a middle portion respectively, and a pin is disposed in each of the pin holes, and the pin is configured to extend out of the pin hole under the action of an elastic force and retract back into the pin hole when being subject to a pressure.

According to a further embodiment of the invention, a receiving hole is disposed on a side surface of each of the sliding sleeves facing the pin holes, wherein the receiving hole is configured to allow the pin to extend out of the pin hole under the action of its elasticity when the receiving hole is aligned with the pin, and then automatically enter into the receiving hole to lock the sliding sleeve on the intermediate longitudinal support bar.

According to a further embodiment of the invention, the positions of the pin holes at the end portions of the intermediate longitudinal support bar are set such that the connecting rods are perpendicular to the intermediate longitudinal support bar when the connecting rods are locked on the intermediate longitudinal support bar; and the position of the pin hole at the middle portion of the intermediate longitudinal support rod is set such that the connecting rods and the intermediate longitudinal support bar abut against one another side by side when the connecting rods are locked.

According to a further embodiment of the invention, the pin is a square pin or a round pin.

According to a further embodiment of the invention, the pin holes are disposed on an upper surface and/or a lower surface of the intermediate longitudinal support bar.

According to a further embodiment of the invention, each of the brackets is mounted on a corresponding sliding sleeve, and each of the brackets is provided with two pivot shafts, each of which is located at a lateral side of the sliding sleeve and extends in a vertical direction. The connecting rod is pivotally connected to the bracket via one of pivot shafts located at the same side of the connecting rod.

According to an embodiment of the invention, the bracket comprises an upper board mounted on an upwardly facing surface of the sliding sleeve and a lower board fixedly mounted on a downwardly facing surface of the sliding sleeve, both lateral sides of the upper board and lower board respectively extend out of the sliding sleeve to form cantilevers, and the pivot shafts are disposed between the cantilevers formed at the same sides of the upper board and lower board.

According to a further embodiment of the invention, the upper board comprises two horizontal meshing plates which are respectively pivotally mounted on the top ends of the two pivot shafts, the meshing plates are in a sector shape and are provided with a gear structure at their arcuate edges which are arranged to face each other, such that the gear structures of the meshing plates can mesh with each other when the meshing plates are pivotally rotated around the pivot shafts, thereby enabling synchronous rotation of the two connecting rods connected to the sliding sleeve.

According to a further embodiment of the invention, the end of the connecting rod connected to the sliding sleeve has an upper side plate and a lower side plate which extend in the horizontal direction and face each other, and the pivot shaft is extended between the upper side plate and the lower side plate. The bracket includes a bearing frame and a retaining plate, wherein the bearing frame is fixedly mounted at a lower side of the sliding sleeve and is projected laterally relative to the sliding sleeve so that it can support the lower surface of the lower side plate, and the retaining plate is positioned above the lower side plate so that the lower side plate is sandwiched between the retaining plate and the bearing frame in order to achieve position limitation of the end of the connecting rod connected to the sliding sleeve in the vertical direction.

According to a further embodiment of the invention, the upper side plate is formed into a partially circular shape with a gear structure formed at a actuate edge, wherein racks extending in the longitudinal direction of the bed frame is disposed at both lateral upper edges of the sliding sleeve respectively, and the gear structures of the respective upper side plates of two connecting rods can respectively mesh with corresponding racks so that the two connecting rods connected to the sliding sleeve can rotate synchronously.

According to a further embodiment of the invention, each of the left longitudinal support bar, the right longitudinal support bar and the intermediate longitudinal support bar comprises two main body sections and an intermediate section connected between the two main body sections, the main body sections and the intermediate section are connected via a connecting sheet disposed with a support bar pivot shaft, wherein the two main body sections are configured to be capable of rotating relative to each other about their respective support bar pivot shafts in a vertical plane relative to the intermediate section so that the bed frame is collapsed or developed in the vertical plane.

According to a further embodiment of the invention, the bed frame further comprises locking means for locking the main body sections relative to the intermediate section when the main body sections rotate in the vertical plane to the collapsed or deployed position.

According to a further embodiment of the invention, the connecting rod comprises a plurality of bushings which are nested one inside another so that the connecting rod can be telescoped in its extension direction.

According to a further embodiment of the invention, in any two adjacent bushings, one is provided with a first alignment hole in which a ball end leaf spring with a protrusion is disposed, the ball end leaf spring is configured to extend out of the first alignment hole under an action of an elastic force and retract back into the first alignment hole when it is subjected to a pressure, the other one of the two adjacent bushings is nested on the first one of the bushings and is disposed with a second alignment hole on its side face opposite to the first alignment hole, the second alignment hole is configured so that when the second alignment hole is aligned with the protrusion, the protrusion can extend out under the action of elasticity, automatically enter the second alignment hole and thereby lock the two adjacent bushings relative to one another.

According to a further embodiment of the invention, the bed frame is configured to be engageable with tongue members for mounting a bedhead member, wherein each of the tongue members comprises a tongue, an upwardly opened slot is provided at the end of the left longitudinal support bar and right longitudinal support bar respectively, and the slot is configured to receive the tongue.

According to a further embodiment of the invention, the left longitudinal support bar, the right longitudinal support bar, and the intermediate longitudinal support bar are respectively provided at both ends and in the middle with legs extending downwardly.

In one embodiment, the legs are also pivotally connected to respective longitudinal support bars, and are rotatable and foldable relative to the respective longitudinal support bars, and in the collapsed state the legs abut against the respective longitudinal support bars side by side.

Another aspect of the present disclosure provides a bed frame, comprising:

a left longitudinal support bar and a right longitudinal support bar which are located on either of lateral sides of the bed frame respectively and extend in a longitudinal direction of the bed frame;

an intermediate longitudinal support bar disposed between the left longitudinal support bar and the right longitudinal support bar and extending in the longitudinal direction of the bed frame, wherein the bed frame further comprises:

four sliding sleeves, wherein two sliding sleeves are disposed spaced apart on the left longitudinal support bar and capable of sliding on the left longitudinal support bar, and the other two sliding sleeves are disposed spaced apart on the right longitudinal support bar and capable of sliding on the right longitudinal support bar, wherein a bracket is disposed on the sliding sleeve; and four connecting rods comprising two left connecting rods extending between the left longitudinal support bar and the intermediate longitudinal support bar and two right connecting rods extending between the right longitudinal support bar and the intermediate longitudinal support bar, wherein one end of each of the connecting rods is pivotally attached to an end of the intermediate longitudinal support bar about a pivot shaft, and the other end of the connecting rod is pivotally attached to a corresponding bracket, wherein the connecting rod is configured so that the end of the connecting rod mounted on the bracket moves along with the sliding sleeve when the sliding sleeve slides along the left longitudinal support bar or right longitudinal support bar, thereby driving the connecting rod to move on a horizontal plane to make the bed frame to be in a deployed state or a collapsed state.

According to a further embodiment of the invention, when the sliding sleeves slide toward each other along the left longitudinal support bar or right longitudinal support bar, the bed frame is gradually collapsed until the bed frame gets into the collapsed state in which the left longitudinal support bar, the right longitudinal support bar, the intermediate longitudinal support bar and the connecting rods abut against one another. When the sliding sleeves slide away from each other along the left longitudinal support bar or right longitudinal support bar, the bed frame is gradually deployed until the bed frame gets into a state in which the respective connecting rods are perpendicular to the left longitudinal support bar, the right longitudinal support bar and the intermediate longitudinal support bar, respectively.

According to a further embodiment of the invention, a pin hole is disposed respectively on the left longitudinal support bar and right longitudinal support bar at positions close to their end portions and middle portion and at a transition position between the end portions and the middle portion, wherein a pin is disposed in each of the pin holes, and the pin is configured to extend out of the pin holes under the action of an elastic force and retract back into the pin holes when being subject to a pressure.

According to a further embodiment of the invention, a receiving hole is disposed on a side of the sliding sleeve opposite to the pin hole, wherein the receiving hole is configured to allow the pin to extend out under the action of its elasticity when the receiving hole is aligned with the pin, and automatically enter the receiving hole to lock the sliding sleeve on the corresponding left longitudinal support bar or right longitudinal support bar.

According to a further embodiment of the invention, the location of the pin holes at the end portions of the left longitudinal support bar or right longitudinal support bar are set so that the connecting rods are perpendicular to the intermediate longitudinal support bar when the connecting rods are locked on the left longitudinal support bar or right longitudinal support bar; the location of the pin hole at the middle portion of left longitudinal support bar or right longitudinal support bar is set so that when the connecting rods are locked, the connecting rods and the intermediate longitudinal support bar abut against one another side by side; and the location of the pin hole at a transition position of left longitudinal support bar or right longitudinal support bar is set so that when the connecting rods are locked, an angle between the connecting rods and the intermediate longitudinal support bar is an acute angle.

According to a further embodiment of the invention, the pin is a square pin or a round pin.

According to a further embodiment of the invention, the pin holes are provided on an upper surface and/or a lower surface of the left longitudinal support bar or the right longitudinal support bar.

According to a further embodiment of the invention, each of the brackets is mounted on a corresponding sliding sleeve and is provided with a pivot shaft located on both lateral sides of the sliding sleeve and extending in a vertical direction, wherein the connecting rod is pivotally connected to the bracket via the pivot shaft.

According to a further embodiment of the invention, the bracket comprises an upper board mounted on an upwardly facing surface of the sliding sleeve and a lower board fixedly mounted on a downwardly facing surface of the sliding sleeve, either of the lateral sides of the upper board and lower board extends out of the sliding sleeve to form a cantilever, wherein the pivot shafts are connected between the cantilevers formed on the same side of the upper board and lower plate.

According to a further embodiment of the invention, the upper board comprises two horizontal meshing plates which are respectively connected to two pivot shafts located on the lateral sides of the sliding sleeve, the meshing plates are in a sector shape and formed with a gear structure at an acute edge thereof, the gear structures of the two upper plates which are connected to one of the sliding sleeves face each other and can mesh with each other, thereby enabling synchronous rotation of the two connecting rods connected to the sliding sleeve.

According to a further embodiment of the invention, an end of the connecting rod that is connected to the sliding sleeve has an upper side plate and a lower side plate which extend in the horizontal direction and face each other, wherein the pivot shaft is located between the upper side plate and the lower side plate, and the bracket includes a bearing frame and a retaining plate, wherein the bearing frame is fixedly mounted on a lower side of the sliding sleeve and extends laterally relative to the sliding sleeve so that it can be supported below the lower side plate, and the retaining plate is positioned above the lower side plate in order to provide a position limitation for the end of the connecting rod connected to the sliding sleeve in the vertical direction.

According to a further embodiment of the invention, the upper side plate is formed into a partially circular shape, at the edge of which a gear structure is formed, wherein a rack extending in the longitudinal direction is disposed on both lateral upper edges of the sliding sleeve respectively, the gear structures of two connecting rods connected to one sliding sleeve can respectively mesh with corresponding racks so that the two connecting rods connected to the sliding sleeve can rotate synchronously.

According to a further embodiment of the invention, the left longitudinal support bar, the right longitudinal support bar and the intermediate longitudinal support bar respectively comprise two main body sections and an intermediate section connected between the two main body sections, the main body sections and the intermediate section are connected via a connecting sheet, a support bar pivot shaft is mounted on the connecting sheet, the two main body sections are configured to be capable of rotating relative to each other about their respective support bar pivot shafts in a vertical plane relative to the intermediate section so that the bed frame is collapsed or deployed in the vertical plane.

According to a further embodiment of the invention, the bed frame further comprises a locking mechanism for locking the main body sections relative to the intermediate section when the main body sections rotate to the collapsed or deployed position in the vertical plane.

According to a further embodiment of the invention, the connecting rod comprises a plurality of bushings which are nested one inside another so that the connecting rod is telescopic in its extension direction.

According to a further embodiment of the invention, in any two adjacent bushings, one bushing is provided with a first alignment hole, a ball end leaf spring with a protrusion is disposed in the first alignment hole, the ball end leaf spring is configured to extend out of the first alignment hole under action of an elastic force and retract back into the first alignment hole when subjected to a pressure, the other bushing is nested around a preceding bushing, a second alignment hole is disposed on a side face of the other bushing facing the first alignment hole, the second alignment hole is configured in a way that when the second alignment hole aligns with the protrusion, the protrusion can extend out under the action of elasticity, automatically enter the second alignment hole and thereby lock the two adjacent bushings relative to one another.

According to a further embodiment of the invention, the bed frame is configured to be engageable with a tongue member for mounting a bedhead member, the tongue member comprises a tongue, an upwardly open slot is provided at the end of the left longitudinal support bar and right longitudinal support bar, and the slot is configured to receive the tongue.

According to a further embodiment of the invention, the left longitudinal support bar, the right longitudinal support bar, and the intermediate longitudinal support bar are respectively provided with downwardly extending legs at both ends and in the middle.

In one embodiment, the legs are also pivotally connected to respective longitudinal support bars, the legs are rotatable and foldable relative to the respective longitudinal support bars, and in the collapsed state the legs abut against the respective longitudinal support bars side by side.

A further aspect of the present disclosure provides a bed frame, comprising:

a left longitudinal support bar and a right longitudinal support bar which are located on both lateral sides of the bed frame respectively and extend in a longitudinal direction of the bed frame;

an intermediate longitudinal support bar disposed between the left longitudinal support bar and the right longitudinal support bar and extending in the longitudinal direction of the bed frame, two spaced-apart sliding sleeves slidably disposed on the intermediate longitudinal support bar, wherein each of the sliding sleeve is provided with a bracket; and four connecting rods comprising two left connecting rods extending between the left longitudinal support bar and the intermediate longitudinal support bar and two right connecting rods extending between the right longitudinal support bar and the intermediate longitudinal support bar, wherein one end of each of the connecting rods is pivotally attached to an end of the left longitudinal support bar or the right longitudinal support bar, and the other end of the connecting rod is pivotally attached to a corresponding bracket, wherein each of the connecting rod is configured so that its end mounted on the bracket moves along with the sliding sleeve when the sliding sleeve slides along the intermediate longitudinal support bar, thereby driving the connecting rod to move on a horizontal plane, as a result of which the bed frame is in a deployed state or a collapsed state; and wherein the bed frame further comprises at least two additional links extending between the intermediate longitudinal support bar and the connecting rods, one end of each of the additional links is pivotally connected to one end of the intermediate longitudinal support bar, the other end is pivotally connected to the connecting rod, and when the connecting rod moves in a horizontal plane, the additional link can be driven by the connecting rod to move in a horizontal plane.

According to a further embodiment of the invention, the additional links comprise two additional links, and the two additional links are located on the same side relative to the intermediate longitudinal support bar; or the additional links comprise two additional links, and the two additional links are located on different sides relative to the intermediate longitudinal support bar.

According to a further embodiment of the invention, the additional links comprise two additional links, and the two additional links are located on different sides relative to the intermediate longitudinal support bar, and one ends of the two additional links are respectively connected to opposing ends of the intermediate longitudinal support bar.

According to a further embodiment of the invention, the additional links comprise four additional links.

According to a further embodiment of the invention, when the sliding sleeves slide toward each other along the intermediate longitudinal support bar, the bed frame is gradually collapsed until the bed frame gets into the collapsed state in which the left longitudinal support bar, the right longitudinal support bar, the intermediate longitudinal support bar and the connecting rods abut against one another. When the sliding sleeves slide away from each other along the intermediate longitudinal support bar, the bed frame is gradually deployed until the bed frame gets into a state in which the respective connecting rods are perpendicular to the left longitudinal support bar, the right longitudinal support bar and the intermediate longitudinal support bar, respectively.

According to a further embodiment of the invention, the intermediate longitudinal support bar is disposed with pin holes at positions close to its end portions and middle portion respectively, and a pin is disposed in each of the pin holes, and the pin is configured to extend out of the pin hole under the action of an elastic force and retract back into the pin hole when being subject to a pressure.

According to a further embodiment of the invention, a receiving hole is disposed on a side of the sliding sleeve facing the pin hole, wherein the receiving hole is configured to allow the pin to extend out under the action of its elasticity when the receiving hole is aligned with the pin, and automatically enter the receiving hole to lock the sliding sleeve on the intermediate longitudinal support bar.

According to a further embodiment of the invention, the positions of the pin holes at the end portions of the intermediate longitudinal support bar are set such that the connecting rods are perpendicular to the intermediate longitudinal support bar when the connecting rods are locked on the intermediate longitudinal support bar; and the position of the pin hole at the middle portion of the intermediate longitudinal support rod is set such that the connecting rods and the intermediate longitudinal support bar abut against one another side by side when the connecting rods are locked.

According to a further embodiment of the invention, the pin is a square pin or a round pin.

According to a further embodiment of the invention, the pin holes are provided on an upper surface and/or a lower surface of the intermediate longitudinal support bar.

According to a further embodiment of the invention, each of the brackets is mounted on a corresponding sliding sleeve, and each of the brackets is provided with a pivot shaft located on both lateral sides of the sliding sleeve and extending in a vertical direction, and the connecting rod is pivotally connected to the bracket via the pivot shaft.

According to a further embodiment of the invention, the bracket comprises an upper board mounted on an upwardly facing surface of the sliding sleeve and a lower board fixedly mounted on a downwardly facing surface of the sliding sleeve, both lateral sides of the upper board and lower board respectively extend out of the sliding sleeve to form cantilevers, and the pivot shafts are connected between the cantilevers on the same side of the upper board and lower plate.

According to a further embodiment of the invention, the upper board comprises two horizontal meshing plates which are respectively connected to two pivot shafts located on both lateral sides of the sliding sleeve, the meshing plates are in a sector shape and provided with a gear structure at an arcuate edge thereof, the gear structures of the two upper plates connected to one sliding sleeve face each other and can mesh with each other, thereby enabling synchronous rotation of the two connecting rods connected to the sliding sleeve.

According to a further embodiment, an end of the connecting rod connected to the sliding sleeve has an upper side plate and a lower side plate which extend in the horizontal direction and face each other, and the pivot shaft is located between the upper side plate and the lower side plate, and the bracket includes a bearing frame and a retaining plate, the bearing frame is fixedly mounted on a lower side of the sliding sleeve and extending laterally relative to the sliding sleeve to be supported below the lower side plate, and the retaining plate is positioned above the lower side plate in order to achieve position limitation of the end of the connecting rod connected to the sliding sleeve in the vertical direction.

According to a further embodiment of the invention, the upper side plate is formed into a partially circular shape, at the edge of which a gear structure is formed, wherein a rack extending in the longitudinal direction is disposed on both lateral upper edges of the sliding sleeve respectively, the gear structures of two connecting rods connected to one sliding sleeve can respectively mesh with corresponding racks so that the two connecting rods connected to the sliding sleeve can rotate synchronously.

According to a further embodiment of the invention, the left longitudinal support bar, the right longitudinal support bar and the intermediate longitudinal support bar respectively comprise two main body sections and an intermediate section connected between the two main body sections, the main body sections and the intermediate section are connected via a connecting sheet, a support bar pivot shaft is mounted on the connecting sheet, the two main body sections are configured to be capable of rotating relative to each other about their respective support bar pivot shafts in a vertical plane relative to the intermediate section so that the bed frame is collapsed or deployed in the vertical plane.

According to a further embodiment of the invention, the bed frame further comprises a locking mechanism for locking the main body sections relative to the intermediate section when the main body sections rotate to the collapsed or deployed position in the vertical plane.

According to a further embodiment of the invention, the connecting rod comprises a plurality of bushings which are nested one inside another so that the connecting rod is telescopic in its extension direction.

According to a further embodiment of the invention, in any two adjacent bushings, one bushing is provided with a first alignment hole, a ball end leaf spring with a protrusion is disposed in the first alignment hole, the ball end leaf spring is configured to extend out of the first alignment hole under action of an elastic force and retract back into the first alignment hole when subjected to a pressure, the other bushing is nested around a preceding bushing, a second alignment hole is disposed on a side face of the other bushing facing the first alignment hole, the second alignment hole is configured in a way that when the second alignment hole aligns with the protrusion, the protrusion can extend out under the action of elasticity, automatically enter the second alignment hole and thereby lock the two adjacent bushings relative to one another.

According to a further embodiment of the invention, the bed frame is configured to be engageable with a tongue member for mounting a bedhead member, the tongue member comprises a tongue, an upwardly open slot is provided at the end of the left longitudinal support bar and right longitudinal support bar, and the slot is configured to receive the tongue.

According to a further embodiment of the invention, the left longitudinal support bar, the right longitudinal support bar, and the intermediate longitudinal support bar are respectively provided with downwardly extending legs at both ends and in the middle.

In one embodiment, the legs are also pivotally connected to respective longitudinal support bars, the legs are rotatable and foldable relative to the respective longitudinal support bars, and in the collapsed state the legs abut against the respective longitudinal support bars side by side.

A further aspect of the present disclosure provides a bed frame, comprising:

a left longitudinal support bar and a right longitudinal support bar which are located on both lateral sides of the bed frame respectively and extend in a longitudinal direction of the bed frame;

an intermediate longitudinal support bar disposed between the left longitudinal support bar and the right longitudinal support bar and extending in the longitudinal direction of the bed frame, four sliding sleeves, wherein two sliding sleeves are disposed spaced apart on the left longitudinal support bar and capable of sliding on the left longitudinal support bar, and the other two sliding sleeves are disposed spaced apart on the right longitudinal support bar and capable of sliding on the right longitudinal support bar, wherein a bracket is disposed on the sliding sleeve; and four connecting rods comprising two left connecting rods extending between the left longitudinal support bar and the intermediate longitudinal support bar and two right connecting rods extending between the right longitudinal support bar and the intermediate longitudinal support bar, wherein one end of each of the connecting rods is pivotally attached to an end of the intermediate longitudinal support bar about a pivot shaft, and the other end of the connecting rod is pivotally attached to a corresponding bracket, wherein each of the connecting rods is configured so that its end mounted on the bracket moves along with the sliding sleeve when the sliding sleeve slides along the left longitudinal support bar or right longitudinal support bar, thereby driving the connecting rod to move on a horizontal plane, as a result of which the bed frame is in an deployed state or a collapsed state; and wherein the bed frame further comprises at least two additional links extending between the left longitudinal support bar and the connecting rods or between the right longitudinal support bar and the connecting rods, one end of each of the additional links is pivotally connected to one end of the left longitudinal support bar or the right longitudinal support bar, the other end is pivotally connected to the connecting rod, and when the connecting rod moves in a horizontal plane, the additional link can be driven by the connecting rod to move in a horizontal plane.

According to a further embodiment of the invention, the additional links comprise two additional links, and the two additional links are located on the same side relative to the intermediate longitudinal support bar; or the additional links comprise two additional links, and the two additional links are located on different sides relative to the intermediate longitudinal support bar.

According to a further embodiment of the invention, the additional links comprise two additional links, and the two additional links are located on different sides relative to the intermediate longitudinal support bar, and one ends of the two additional links are respectively connected to opposing ends of the intermediate longitudinal support bar.

According to a further embodiment of the invention, the additional links comprise four additional links According to a further embodiment, when the sliding sleeves slide toward each other along the left longitudinal support bar or right longitudinal support bar, the bed frame is gradually collapsed until the bed frame gets into the collapsed state in which the left longitudinal support bar, the right longitudinal support bar, the intermediate longitudinal support bar and the connecting rods abut against one another. When the sliding sleeves slide away from each other along the left longitudinal support bar or right longitudinal support bar, the bed frame is gradually deployed until the bed frame gets into a state in which the respective connecting rods are perpendicular to the left longitudinal support bar, the right longitudinal support bar and the intermediate longitudinal support bar, respectively.

According to a further embodiment of the invention, the left longitudinal support bar or right longitudinal support bar is disposed with pin holes at positions close to its end portions and middle portion respectively and at a transition position between the end portions and the middle portion, respectively, and a pin is disposed in each of the pin holes, and the pin is configured to extend out of the pin hole under the action of an elastic force and retract back into the pin hole when being subject to a pressure.

According to a further embodiment of the invention, a receiving hole is disposed on a side of the sliding sleeve facing the pin hole, wherein the receiving hole is configured to allow the pin to extend out under the action of its elasticity when the receiving hole is aligned with the pin, and automatically enter the receiving hole to lock the sliding sleeve on the left longitudinal support bar or right longitudinal support bar.

According to a further embodiment of the invention, the pin holes at the end portions of the left longitudinal support bar or right longitudinal support bar are positioned in a way that the connecting rods are perpendicular to the intermediate longitudinal support bar when the connecting rods are locked on the left longitudinal support bar or right longitudinal support bar; the pin hole at the middle portion of left longitudinal support bar or right longitudinal support bar is positioned in a way that when the connecting rods are locked, the connecting rods and the intermediate longitudinal support bar abut against one another side by side; the pin hole at the transition position of left longitudinal support bar or right longitudinal support bar is positioned in a way that when the connecting rods are locked, an angle between the connecting rods and the intermediate longitudinal support bar is an acute angle.

According to a further embodiment of the invention, the pin is a square pin or a round pin.

According to a further embodiment of the invention, the pin holes are provided on an upper surface and/or a lower surface of the left longitudinal support bar or the right longitudinal support bar.

According to a further embodiment of the invention, each of the brackets is mounted on a corresponding sliding sleeve, and each of the brackets is provided with a pivot shaft located on both lateral sides of the sliding sleeve and extending in a vertical direction, and the connecting rod is pivotally connected to the bracket via the pivot shaft.

According to a further embodiment of the invention, the bracket comprises an upper board mounted on an upwardly facing surface of the sliding sleeve and a lower board fixedly mounted on a downwardly facing surface of the sliding sleeve, both lateral sides of the upper board and lower board respectively extend out of the sliding sleeve to form cantilevers, and the pivot shafts are connected between the cantilevers on the same side of the upper board and lower plate.

According to a further embodiment of the invention, the upper board comprises two horizontal meshing plates which are respectively connected to two pivot shafts located on both lateral sides of the sliding sleeve, the meshing plates are in a sector shape and provided with a gear structure at an arcuate edge thereof, the gear structures of the two upper plates connected to one sliding sleeve face each other and can mesh with each other, thereby enabling synchronous rotation of the two connecting rods connected to the sliding sleeve.

According to a further embodiment of the invention, an end of the connecting rod connected to the sliding sleeve has an upper side plate and a lower side plate which extend in the horizontal direction and face each other, and the pivot shaft is located between the upper side plate and the lower side plate, and the bracket includes a bearing frame and a retaining plate, the bearing frame is fixedly mounted on a lower side of the sliding sleeve and extending laterally relative to the sliding sleeve to be supported below the lower side plate, and the retaining plate is positioned above the lower side plate in order to achieve position limitation of the end of the connecting rod connected to the sliding sleeve in the vertical direction.

According to a further embodiment of the invention, the upper side plate is formed into a partially circular shape, at the edge of which a gear structure is formed, wherein a rack extending in the longitudinal direction is disposed on both lateral upper edges of the sliding sleeve respectively, the gear structures of two connecting rods connected to one sliding sleeve can respectively mesh with corresponding racks so that the two connecting rods connected to the sliding sleeve can rotate synchronously.

According to a further embodiment of the invention, the left longitudinal support bar, the right longitudinal support bar and the intermediate longitudinal support bar respectively comprise two main body sections and an intermediate section connected between the two main body sections, the main body sections and the intermediate section are connected via a connecting sheet, a support bar pivot shaft is mounted on the connecting sheet, the two main body sections are configured to be capable of rotating relative to each other about their respective support bar pivot shafts in a vertical plane relative to the intermediate section so that the bed frame is collapsed or deployed in the vertical plane.

According to a further embodiment of the invention, the bed frame further comprises a locking mechanism for locking the main body sections relative to the intermediate section when the main body sections rotate to the collapsed or deployed position in the vertical plane.

According to a further embodiment of the invention, the connecting rod comprises a plurality of bushings which are nested one inside another so that the connecting rod is telescopic in its extension direction.

According to a further embodiment of the invention, in any two adjacent bushings, one bushing is provided with a first alignment hole, a ball end leaf spring with a protrusion is disposed in the first alignment hole, the ball end leaf spring is configured to extend out of the first alignment hole under action of an elastic force and retract back into the first alignment hole when subjected to a pressure, the other bushing is nested around a preceding bushing, a second alignment hole is disposed on a side face of the other bushing facing the first alignment hole, the second alignment hole is configured in a way that when the second alignment hole aligns with the protrusion, the protrusion can extend out under the action of elasticity, automatically enter the second alignment hole and thereby lock the two adjacent bushings relative to one another.

According to a further embodiment of the invention, the bed frame is configured to be engageable with a tongue member for mounting a bedhead member, the tongue member comprises a tongue, an upwardly open slot is provided at the end of the left longitudinal support bar and right longitudinal support bar, and the slot is configured to receive the tongue.

According to a further embodiment of the invention, the left longitudinal support bar, the right longitudinal support bar, and the intermediate longitudinal support bar are respectively provided with downwardly extending legs at both ends and in the middle.

In one embodiment, the legs are also pivotally connected to respective longitudinal support bars, the legs are rotatable and foldable relative to the respective longitudinal support bars, and in the collapsed state the legs abut against the respective longitudinal support bars side by side.

In the bed frame provided by the present disclosure, the support bars for bearing weight are connected via the connecting rods, the connecting rods are driven to move by enabling an end of the connecting rods to slide on the support bars, thereby achieving the unfolding or folding of the bed frame. Such arrangement can enable quick and effective folding of the bed frame. The space occupied by the collapsed bed frame is small. The folding process is relatively simple and easy to implement. Furthermore, the bed frame exhibits better strength and stability. In either the deployed state or collapsed state, the bed frame can bear a larger weight and can satisfy many demands of the user.

BRIEF DESCRIPTION OF DRAWINGS

Reference may be made to preferred embodiments shown in the figures to enable better understanding of the above and other objects, features, advantages and functions of the present disclosure. The same reference numerals in the figures denote the same parts. Those skilled in the art should appreciate that the figures are intended to schematically illustrate the preferred embodiments of the present disclosure, and not intended to impose any limitations to the scope of the present disclosure. All parts in the figures are not drawn to scale.

DETAILED DESCRIPTION OF PREFERRED EMBODIMENTS

Specific embodiments of the present disclosure will now be described in detail with reference to the figures. Those skilled in the art can implement other manners of the present disclosure on the basis of the preferred embodiments, and other manners also fall within the scope of the present disclosure.

Referring to FIG. 1 through FIG. 13, a bed frame is provided in a first embodiment of the present disclosure.

Figure 1:
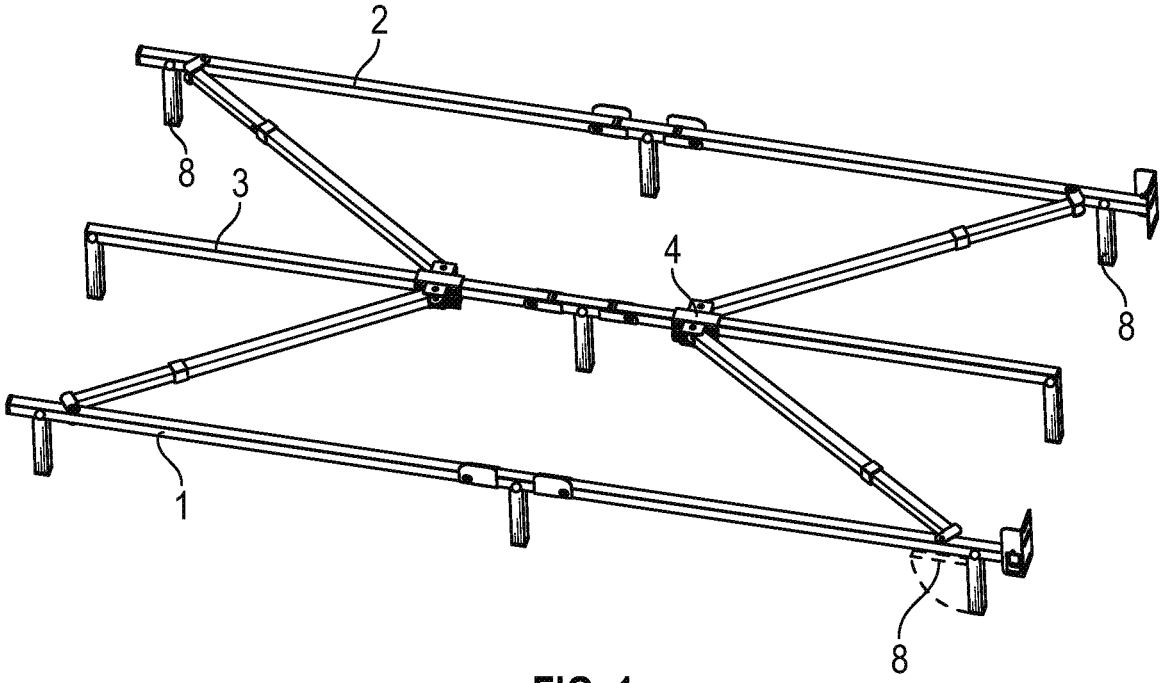
FIG. 1 is a schematic view of a bed frame according to a first embodiment of the present disclosure, wherein the bed frame is in a semi-unfolded state.
Figure 2:
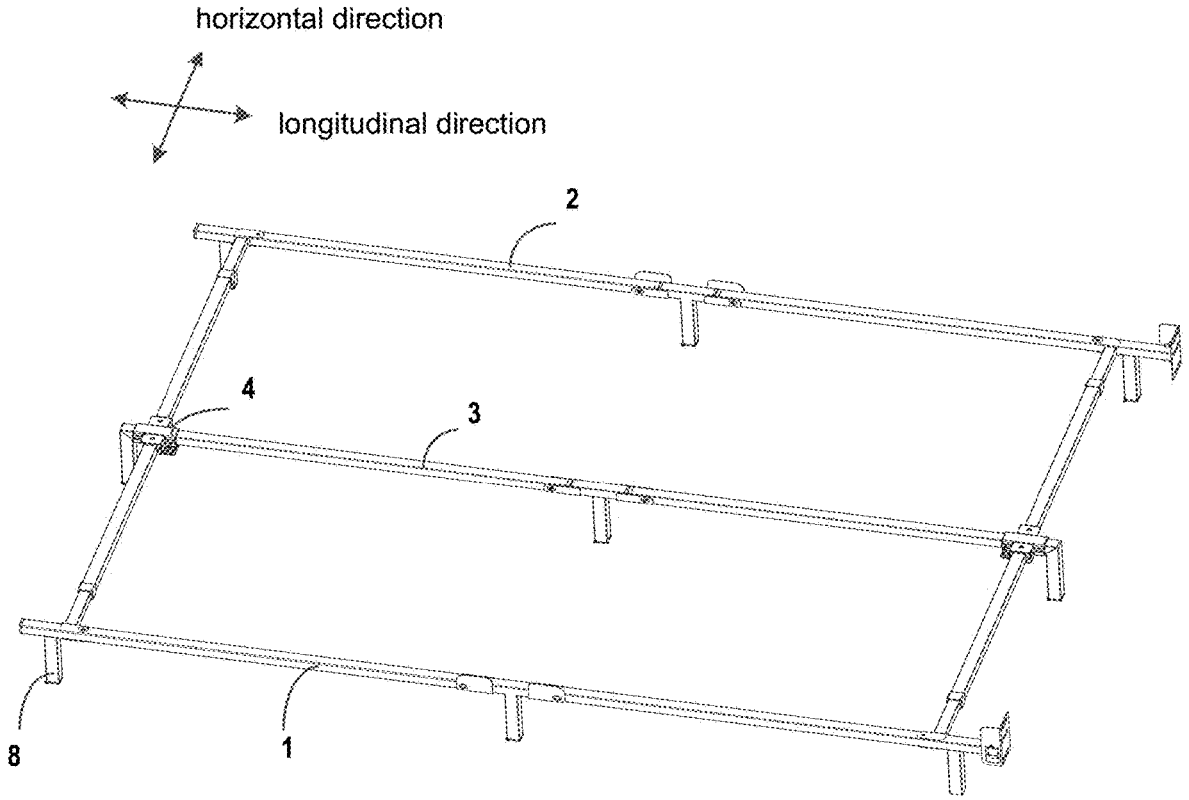
FIG. 2 is another schematic view of the bed frame, wherein the bed frame is in an deployed state.
Figure 3:
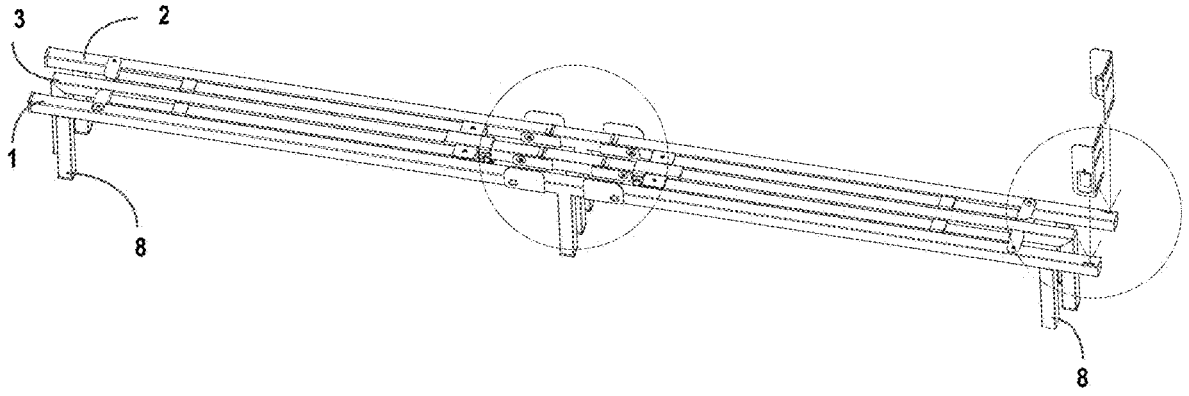
FIG. 3 is a further schematic view of the bed frame, wherein the bed frame is in a collapsed state.

Referring to FIG. 1 through FIG. 3, it can be seen that the bed frame includes a left longitudinal support bar 1, a right longitudinal support bar 2 and an intermediate longitudinal support bar 3 therebetween which are highly rigid and used to bear a weight. The three longitudinal support bars each extend in a longitudinal direction, and the three longitudinal support bars are each provided with legs 8 located at both ends and in the middle and extending downward. At the same time, the intermediate longitudinal support bar 3 is provided with two sliding sleeves 4 spaced apart from each other a certain distance and being capable of sliding on the intermediate longitudinal support bar 3, and the sliding sleeves 4 are mounted with brackets.

It should be appreciated that extension directions of the various components mentioned in the present disclosure (for example, "a transverse direction", "a longitudinal direction" and "a vertical direction") all refer to the extensions directions of the components in the case that the bed frame is placed in a horizontal plane, so directional terms mentioned in the text should be understood to be relative terms rather than absolute terms. Furthermore, it can be understood that both "transverse direction" and "longitudinal direction" are horizontal directions, and they together define a horizontal plane, and the vertical direction is a direction perpendicular to the horizontal plane.

Further referring to FIG. 1 through FIG. 3, connecting rods 5 are further connected between the left longitudinal support bar 1 or the right longitudinal support bar 2 and the intermediate longitudinal support bar 3, there are totally four connecting rods 5, one end of each connecting rod 5 is pivotally attached to an end of the left longitudinal support bar 1 or right longitudinal support bar 2 about a pivot shaft, and the other end of the connecting rod is pivotally attached to a corresponding bracket about a pivot shaft. As such, when the sliding sleeve 4 slides along the intermediate longitudinal support bar 3, the end of the connecting rod 5 connected to the corresponding bracket moves along with the sliding sleeve 4, thereby driving the connecting rod 5 to move in a horizontal plane and thereby transversely unfolding or folding the bed frame.

Specifically, when the two sliding sleeves 4 slide toward each other along the intermediate longitudinal support bar 3, the bed frame is gradually collapsed until it gets into a collapsed state in which the left longitudinal support bar 1, the right longitudinal support bar 2 and the intermediate longitudinal support bar 3 abut against one another side by side, the collapsed state being shown by FIG. 3; when the sliding sleeves 4 slide away from each other along the intermediate longitudinal support bar 3, the bed frame is gradually deployed until the bed frame gets into an deployed state in which the respective connecting rods 5 are perpendicular to respective longitudinal support bars respectively, the deployed state being shown by FIG. 2.

In order to fix the sliding sleeve 4 on the intermediate longitudinal support bar 3 and thereby fix the connecting rods 5, a pin hole is provided on a surface of the intermediate longitudinal support bar 3, an elastic pin is disposed in the pin hole, the pin is configured to extend out of the pin hole under the action of an elastic force and retract back into the pin hole when subjected to a pressure, a surface of the sliding sleeve 4 corresponding to the pin hole is provided with a receiving hole 41, and the pin and the receiving hole 41 can engage with each other to lock the sliding sleeve 4. Specifically, the pin hole includes end pin holes and a middle pin hole which respectively receive end pins and a middle pin, and the end pin holes and the middle pin hole are respectively located at the intermediate longitudinal support bar 3 close to its end positions and close to a middle position.

Wherein, the end pin is used to engage with the receiving hole 41 to fix the connecting rod 5 perpendicular to the longitudinal support bar. When the end pin engages with the receiving hole 41, the connecting rod 5 extends transversely, and the bed frame is in the deployed state as stated above; the middle pin is used to engage with the receiving hole 41 to fix the connecting rod 5 parallel to the longitudinal support bar, and when the middle pin engages with the receiving hole 41, the bed frame is in the collapsed state as described above.

Preferably, an intermediate pin hole may be provided at an intermediate position between the end pin hole and the middle pin hole to fix the bed frame in a semi-unfolded state, which may be similar to that shown in FIG. 1. On the intermediate longitudinal support bar 3, a distance between the two middle pin holes may be ⅕-⅓ of the length of the intermediate longitudinal support bar 3, for example ¼. Each of the examples shown in FIGS. 4 to 7 may be understood to mean that the intermediate pin engages with the receiving hole 41 to fix the bed frame in the semi-unfolded state, whereupon an angle between the connecting rods and the intermediate longitudinal support bar is an acute angle so that the bed frame is formed as a twin size bed frame.

More preferably, more pin holes and pins at multiple different positions may be disposed so that the angle between the connecting rods 5 and respective longitudinal support bars gradually changes such that the bed frame can be fixed at different positions to change more sizes. For example, when the bed frame is completely folded in the horizontal plane, it is formed as a single size bed frame; when the bed frame is semi-unfolded in the horizontal plane, it is formed as a twin size bed frame; next, the bed frame may be further unfolded again for many times such that the bed frame is formed as a full size bed frame, a queen size bed frame, a king size bed frame, a California king size bed frame or the like.

Figure 4:
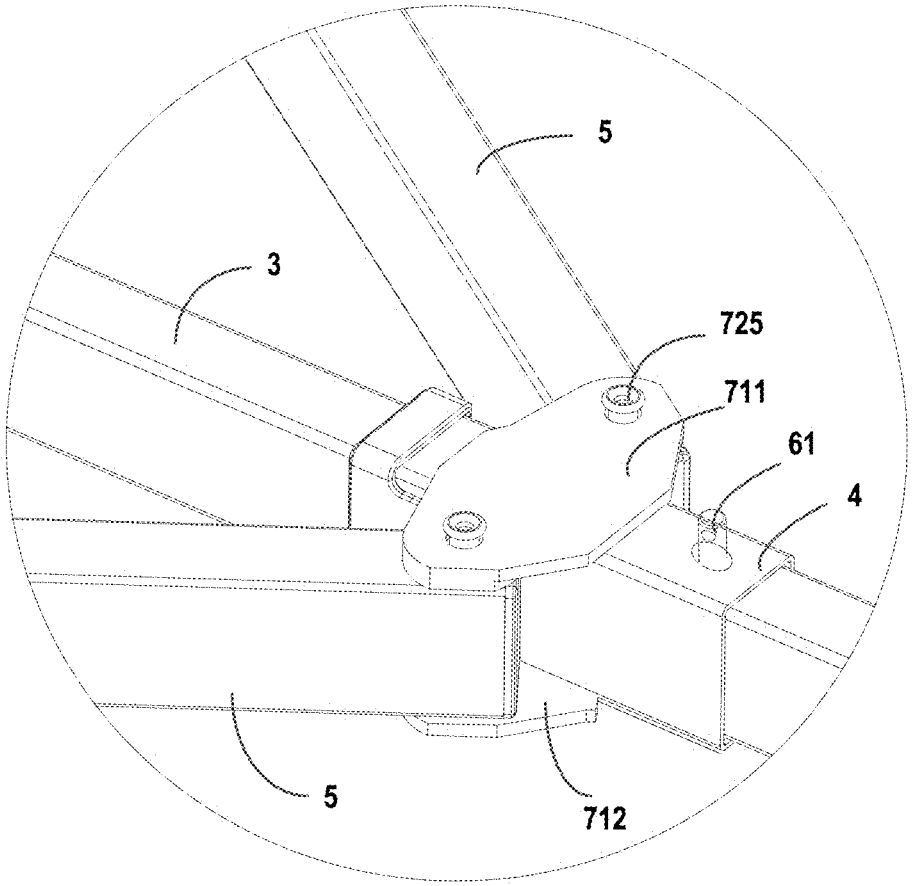
FIG. 4 is a schematic view of a sliding sleeve of the bed frame.
Figure 5:
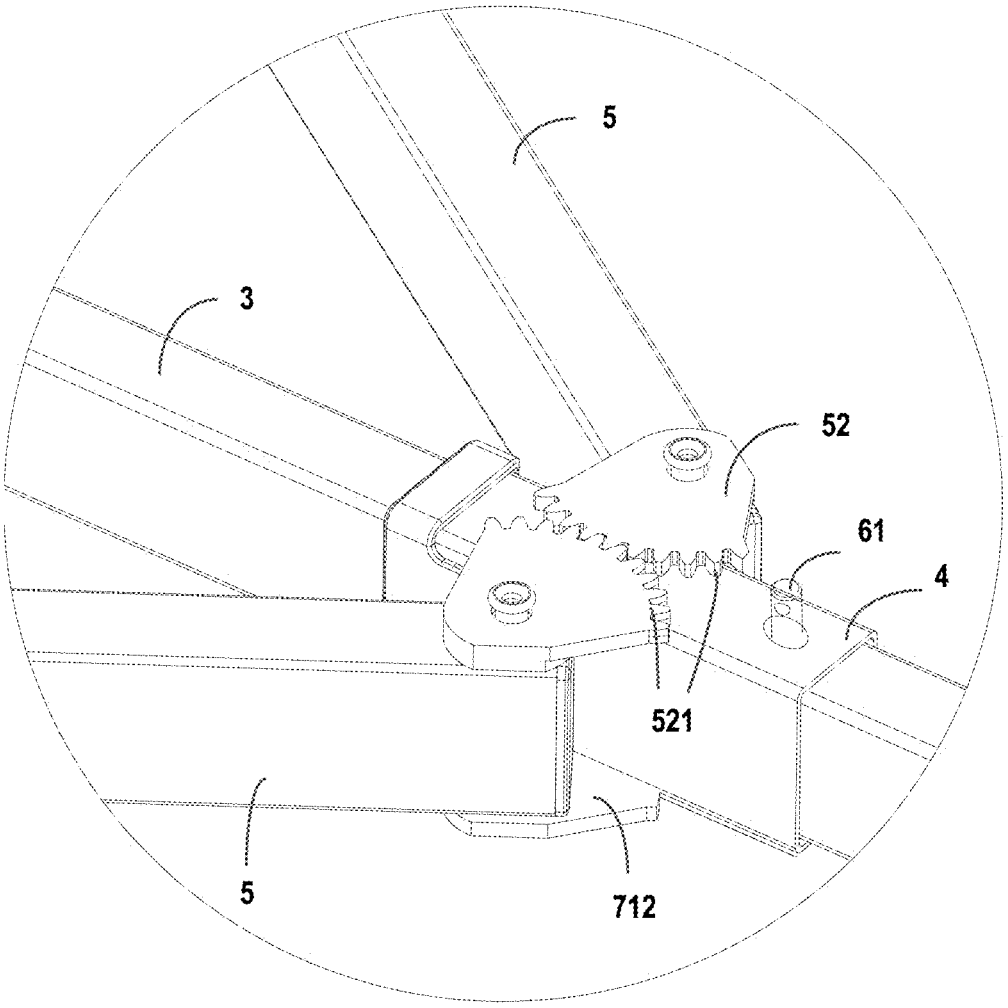
FIG. 5-FIG. 7 are schematic views of several alternative embodiments of the sliding sleeve of the bed frame.
Figure 6:
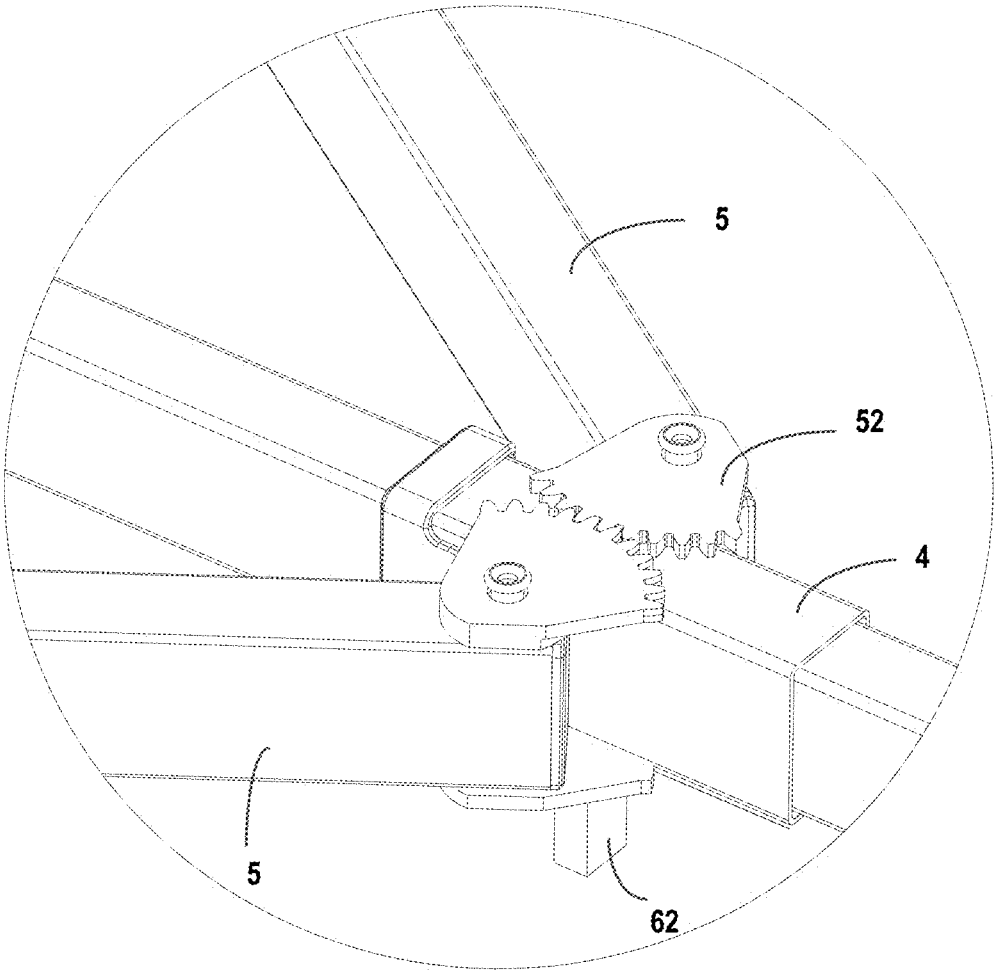
Figure 7:
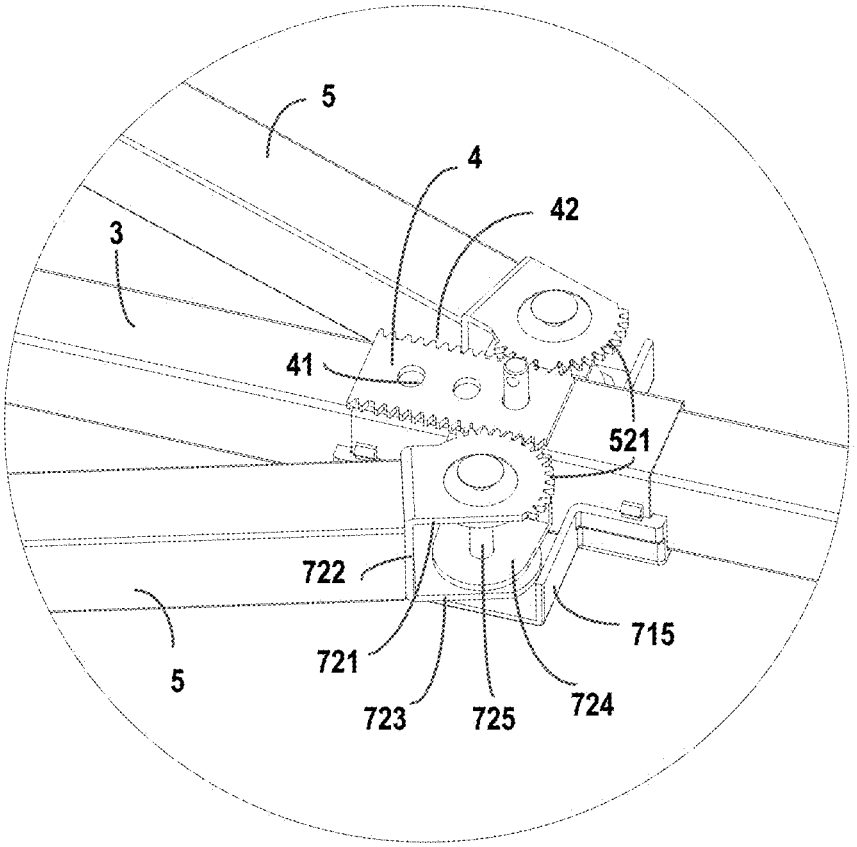
Figure 8:
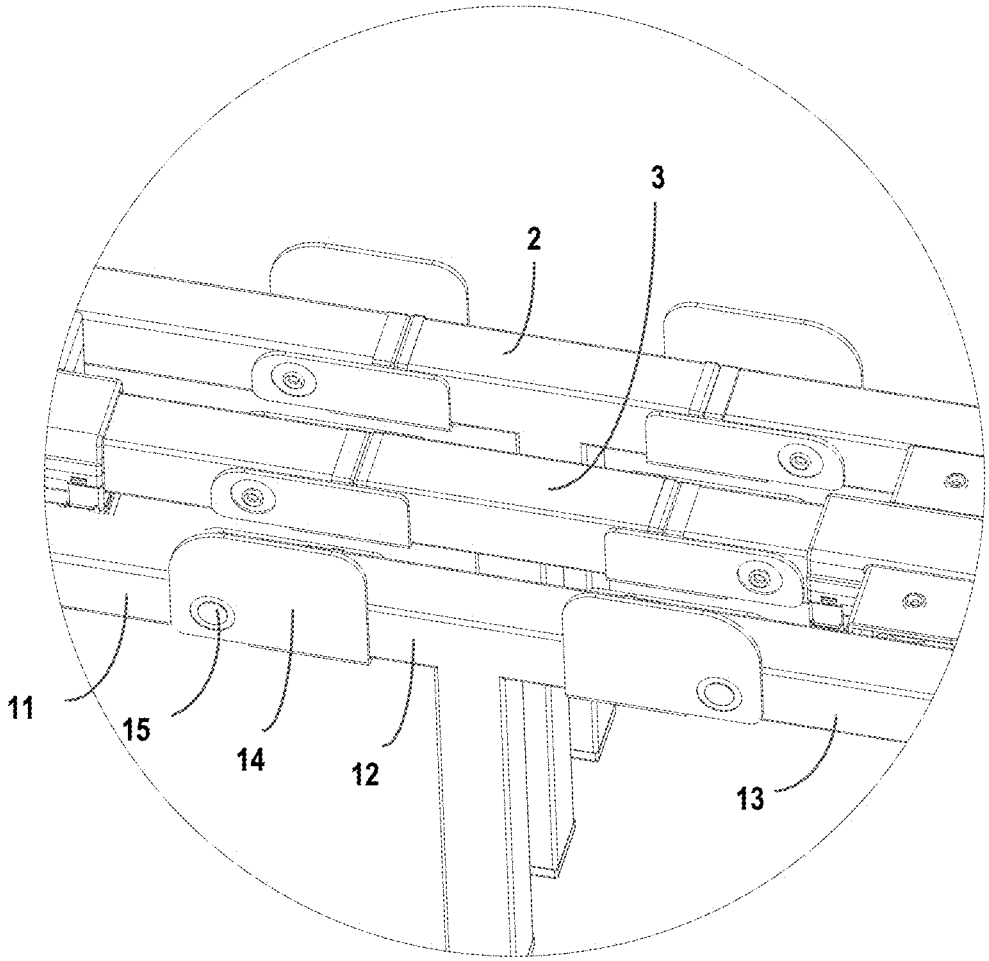
FIG. 8 is a partial enlarged view of FIG. 3.

Preferably, the pin may be a round pin 61 (as shown in FIGS. 4, 5 and 7) or a square pin 62 (as shown in FIG. 6) which may be disposed on an upper surface and/or lower surface of the intermediate longitudinal support bar 3. More preferably, as shown in FIG. 7, the sliding sleeve 4 may further be provided with a plurality of receiving holes 41 arranged in the longitudinal direction, and each of the receiving holes 41 can engage with the pin to lock the sliding sleeve 4 at different positions of the intermediate longitudinal support bar 3.

The arrangement of the connection of the connecting rod 5 to the sliding sleeve 4 may have various implementation modes, and several examples are shown in FIG. 4 to FIG. 7. In several modes, the sliding sleeve 4 is mounted with a bracket, and the bracket is provided with a pivot shaft 725 positioned on both lateral sides of the sliding sleeve 4 and extending in a vertical direction, and the connecting rod 5 is connected to the bracket via the pivot shaft 725.

In the solution shown in FIG. 4, the bracket includes an upper board 711 mounted on a upward facing surface of the sliding sleeve 4 and a lower board 712 fixedly mounted on a downward facing surface of the sliding sleeve 4, both lateral sides of the upper board 711 and lower board 712 respectively extend out of the sliding sleeve 4 to form cantilevers, and the pivot shaft 725 is connected between the cantilevers on the same side of the upper board 711 and lower board 712.

FIG. 5 and FIG. 6 show variations of the solution shown in FIG. 4. In FIG. 5 and FIG. 6, the upper board 711 includes two horizontal meshing plates 52 which are respectively connected to two pivot shafts 725 located on both lateral sides of the sliding sleeve 4, and the meshing plates 52 are rotatable relative to the sliding sleeve 4 in a horizontal plane. The meshing plates 52 are in a sector shape and provided with a gear structure 521 on an arcuate edge thereof. The two gear structures 521 connected to one sliding sleeve 4 face each other and can mesh with each other, thereby enabling synchronous rotation of the two connecting rods 5 connected to the same sliding sleeve 4 when the sliding sleeve 4 slides. The solutions of FIG. 5 and FIG. 6 are substantially similar, but it can be seen that the locking of the sliding sleeve 4 is achieved via the round pin 61 disposed on the upper surface of the support bar and the receiving hole 41 corresponding thereto in FIG. 5, and the locking of the sliding sleeve 4 is achieved via the square pin 62 disposed on the lower surface of the support bar and the receiving hole corresponding thereto in FIG. 6.

Then turning to FIG. 7, FIG. 7 shows a further variation of FIG. 4. An end of the connecting rod 5 connected to the sliding sleeve 4 has an upper side plate 721 and a lower side plate 723 which extend in the horizontal direction and face each other, and the upper side plate 721 and the lower side plate 723 are connected by a vertical connecting portion 722. The pivot shaft 725 is located between the upper side plate 721 and the lower side plate 723. Furthermore, the bracket includes a bearing frame 715 and a retaining plate 724, the bearing frame 715 is fixedly mounted on the lower side of the sliding sleeve 4 and extending laterally relative to the sliding sleeve 4 to support the lower side plate 723 below the lower side plate 723, and the retaining plate 724 is positioned above the lower side plate 723 to achieve limitation of the end of the connecting rod 5 connected to the sliding sleeve 4 in the vertical direction.

Further referring to FIG. 7, the upper side plate 721 is formed as a substantially circular shape, an edge of the circular shape is formed as a gear structure 521, a rack 42 extending in the longitudinal direction is disposed on both lateral upper edges of the sliding sleeve 4 respectively, the gear structures 521 of two connecting rods 5 connected to a sliding sleeve 4 can respectively mesh with corresponding racks 42 so that the two connecting rods 5 connected to the sliding sleeve 4 can rotate synchronously when the sliding sleeve 4 slides.

Figure 9:
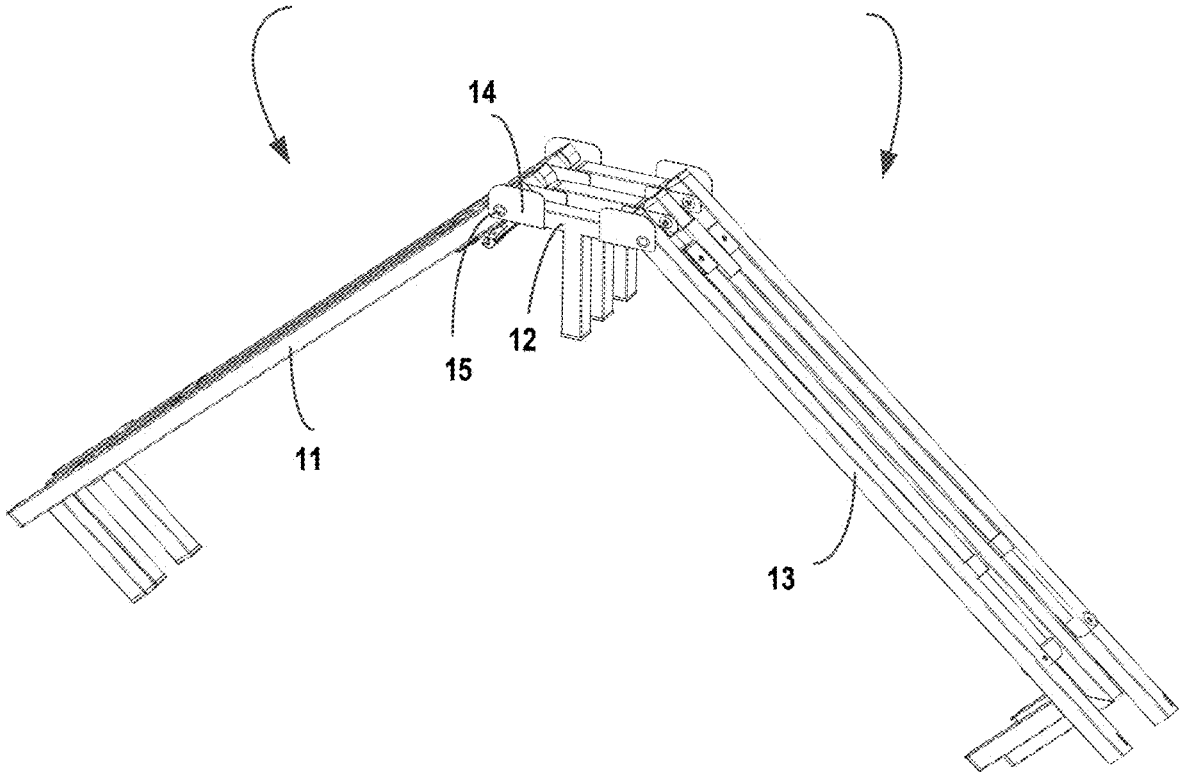
FIG. 9 is a schematic view of a semi-folded state of the bed frame in a vertical plane.
Figure 10:
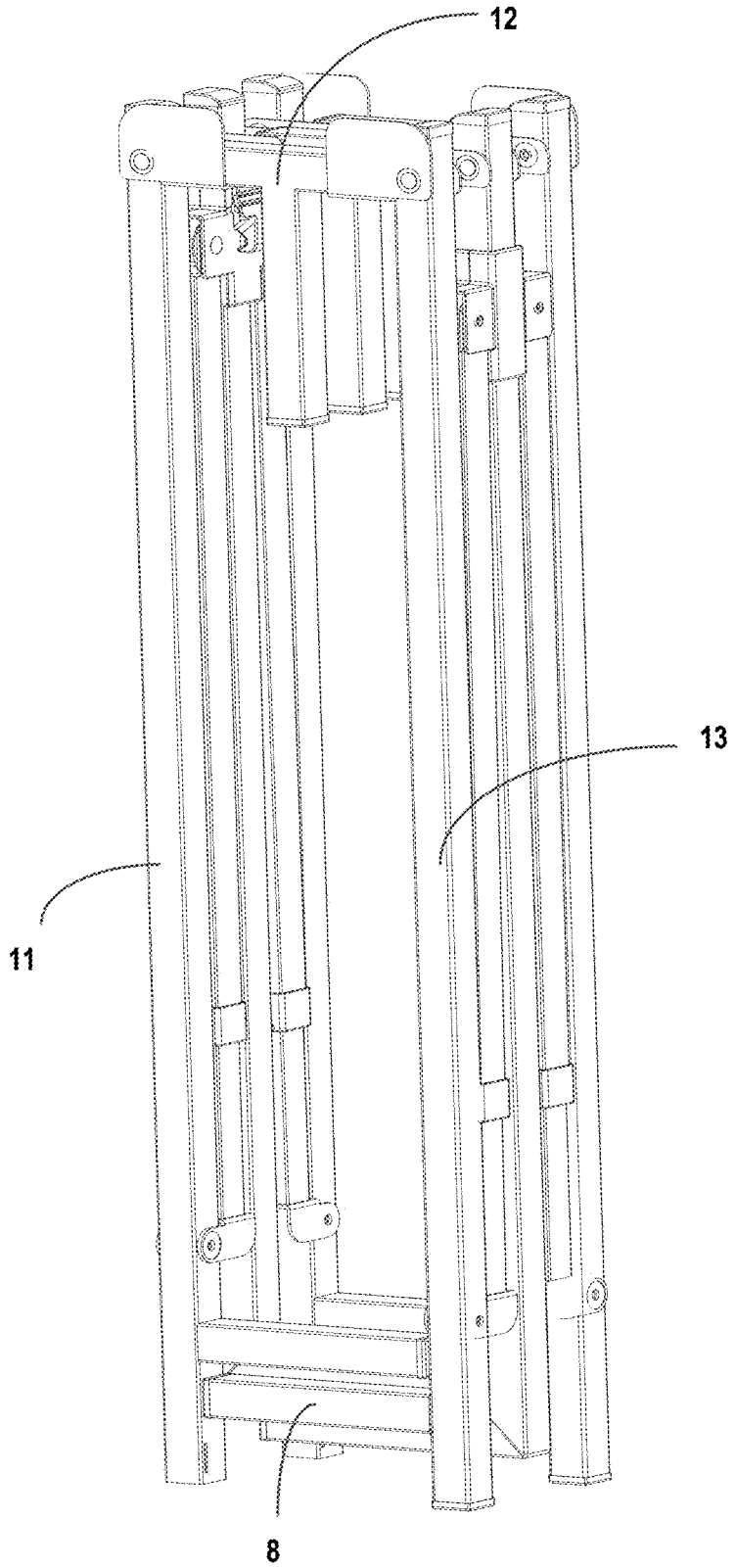
FIG. 10 is a schematic view of a collapsed state of the bed frame in a vertical plane.

Preferably, the bed frame may further be configured to be folded in a vertical plane to further reduce the space occupied by the bed frame in its collapsed state. Now turning to FIG. 8 to FIG. 10, it can be seen that each of the three support bars comprises three portions: two main body sections (i.e., a first main body section 11 and a second main body section 13) and an intermediate section 12 connected between the two main body sections. A connecting sheet 14 is disposed at a connecting position of the main body sections and the intermediate section 12, a support bar pivot shaft 15 is mounted on the connecting sheet 14, the two main body sections are capable of rotating relative to each other about their respective support bar pivot shafts 15 in the vertical plane relative to the intermediate section 12 so that the bed frame is collapsed or deployed in the vertical plane. FIG. 9 through FIG. 10 show a process in which the bed frame is gradually collapsed. Arrows in FIG. 9 show movement directions of the main body sections.

More preferably, a length of the intermediate section 12 may be set equal to that of the leg 8, so that after the bed frame is folded in the vertical plane, the bed frame may be formed into a relatively standard rectangle in the vertical plane, as shown in FIG. 10. This can facilitate the storage of the bed frame, reduce the occupied space, and is visually more beautiful.

On the other hand, in order to further adjust the size of the bed frame in the transverse direction, the connecting rod 5 may be arranged to include at least two bushings which are nested one inside the other so that the connecting rod 5 is telescopic in its extension direction. When the bed frame is already in the deployed state, the size of the bed frame as a whole in the transverse direction can be further adjusted by adjusting the size of an overlapping portion between adjacent bushings.

Figure 11:
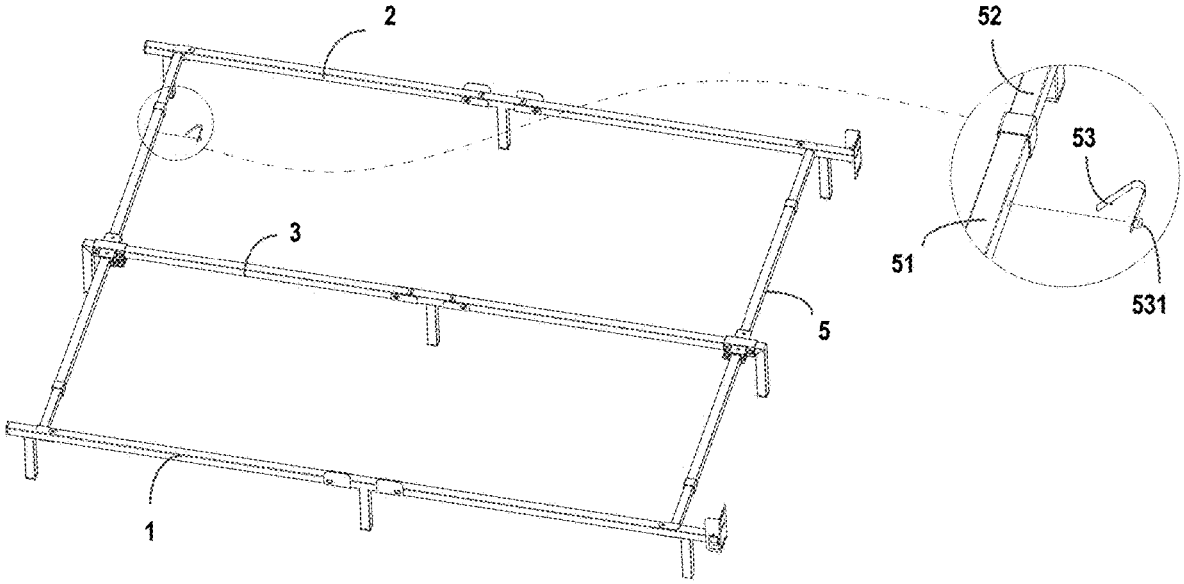
FIG. 11 and FIG. 12 are two other schematic views of the bed frame, wherein the connecting rods are telescope along its extension direction.
Figure 12:
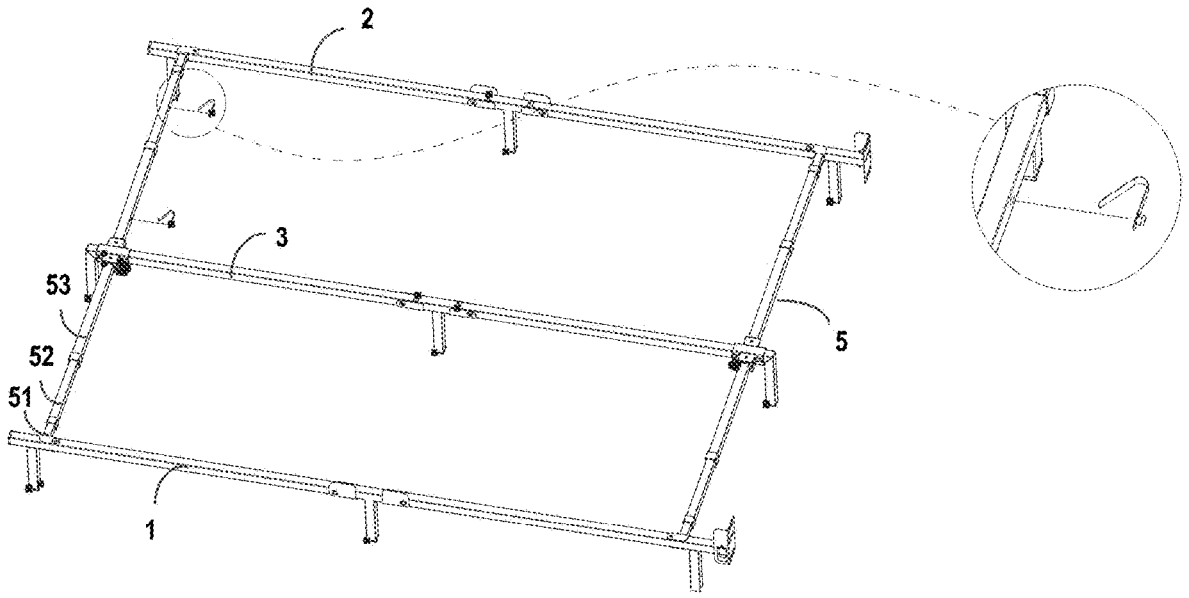
Figure 13:
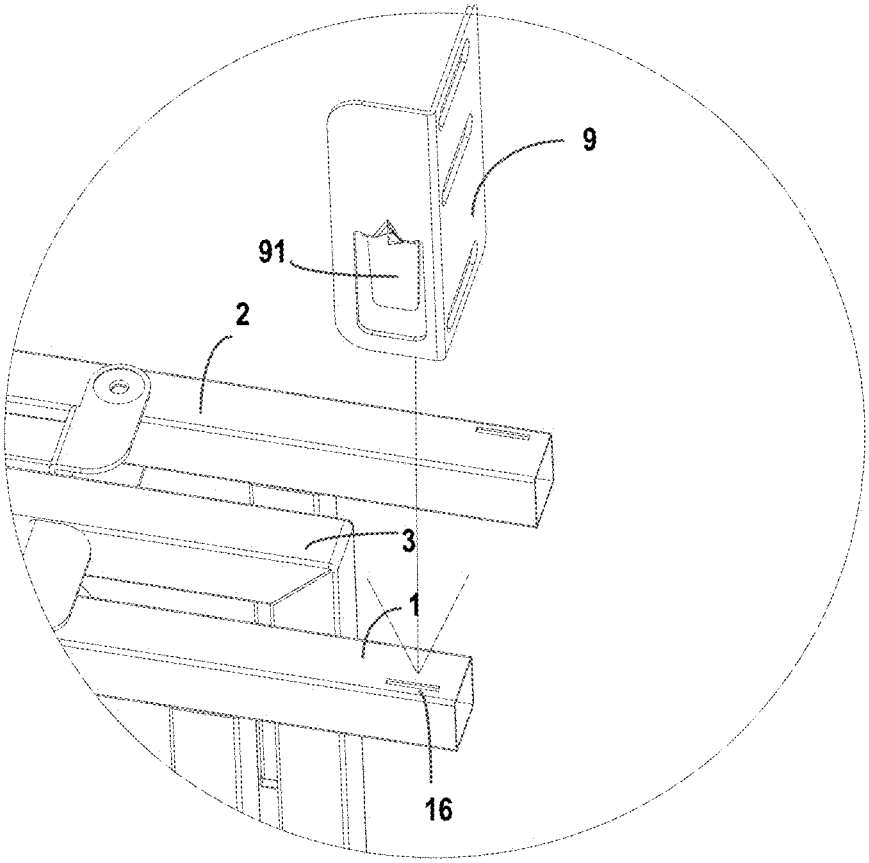
FIG. 13 is a schematic view of the bed frame and the tongue member.

For example, in the bed frame of FIG. 11, each of the connecting rods 5 includes two bushings—a first bushing 51 and a second bushing 52, whereas in the bed frame in FIG. 12, each of the connecting rods 5 further comprises a third bushing 53. Preferably, the fixation between adjacent bushings may be achieved by providing a ball end leaf spring 53 between the bushings. For the two adjacent bushings, one bushing is provided with a first alignment hole, and an elastic ball end leaf spring 53 with a protrusion 53 is disposed in the first alignment hole, the ball end leaf spring 53 can allow the protrusion 531 to extend out of the first alignment hole under action of an elastic force, and allow the protrusion 531 to retract when compressed. The other bushing is nested around a preceding bushing, a second alignment hole is disposed on the second bushing, and when the second alignment hole aligns with the first alignment hole, the protrusion 531 extends into the second alignment hole under the action of the elasticity of the ball end leaf spring 53, thereby locking the two bushings.

Preferably, the bed frame is also engageable with a tongue member 9 for mounting a bedhead member, the tongue member 9 comprises a tongue 91, an upwardly open slot 16 is further provided at the end of the left longitudinal support bar 1 and right longitudinal support bar 2, and the tongue 91 can be inserted into the slot 16.

At the same time, in other embodiments not shown, the bed frame may also have other arrangements. For example, it is also possible to arrange the legs 8 below the longitudinal support bars to be foldable, for example to pivotally connect the legs 8 to the longitudinal support bars, the legs 8 being capable of abutting against the respective longitudinal support bars when the legs 8 are folded.

Figure 14:
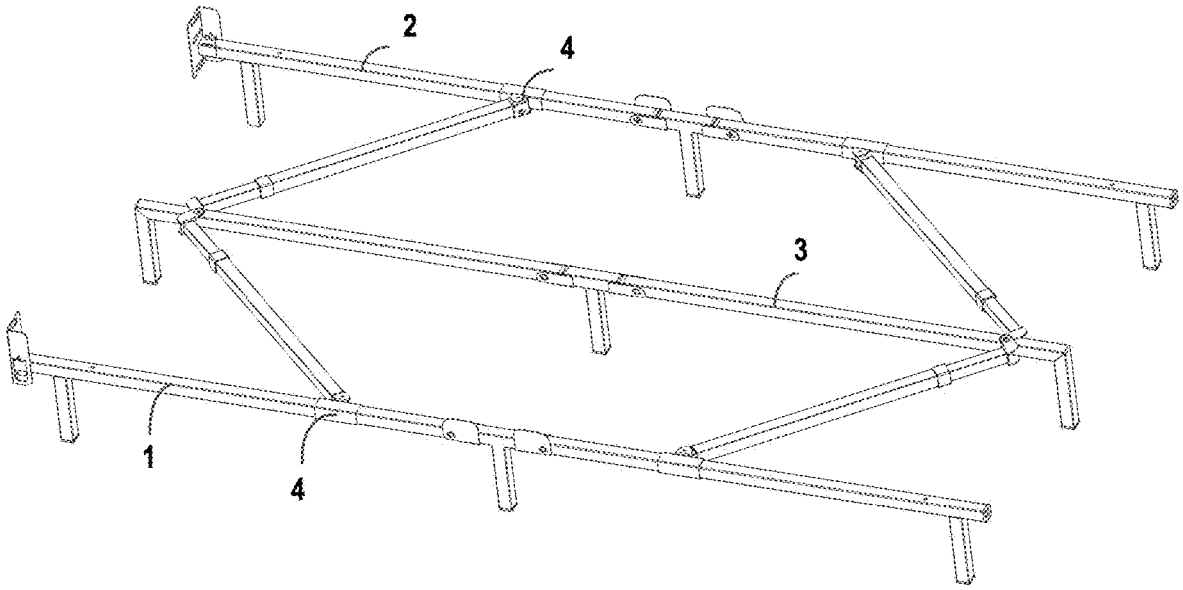
FIG. 14 is a schematic view of a bed frame according to a second embodiment of the present disclosure, wherein the bed frame is in a semi-unfolded state.

FIG. 14 shows a second embodiment of the disclosure.

In the present embodiment, two sliding sleeves 4 are disposed spaced apart on both the left longitudinal support bar 1 and right longitudinal support bar 2, and the sliding sleeves 4 are slideable on the longitudinal support bars. Therefore, in the present embodiment, there are a total of four sliding sleeves 4, and the sliding sleeves 4 each are provided with a bracket.

There are still a total of four connecting rods 5, one end of each connecting rod 5 is pivotally attached to the end of the intermediate longitudinal support bar 3 about a pivot shaft, and the other end of the connecting rod 5 is pivotally attached to a corresponding bracket about a pivot shaft.

Wherein, when the sliding sleeve 4 slides along the corresponding longitudinal support bar, one end of the sliding sleeve 4 mounted on the bracket moves along with the sliding sleeve 4, thereby driving the connecting rod 5 to rotate in a horizontal plane, and thereby causing the bed frame to be in a deployed state or collapsed state.

Other configurations and arrangements of the present embodiment are similar to those of the previous embodiment, and are not described any longer herein for the sake of simplicity.

FIG. 15 through FIG. 18 show a third embodiment of the present disclosure. The basic structure of the bed frame in the present embodiment is similar to that of the first embodiment described above. In the present embodiment, the bed frame further includes an additional link 56 extending between the intermediate longitudinal support bar 3 and the connecting rod, one end of each additional link 56 is pivotally connected to one end of the intermediate longitudinal support bar 3, the other end of the additional link 56 is pivotally connected to its corresponding connecting rod. And when the connecting rod is driven by the sliding sleeve 4 to move in a horizontal plane, the additional link 56 can be driven by the connecting rod to move in a horizontal plane.

Figure 15:
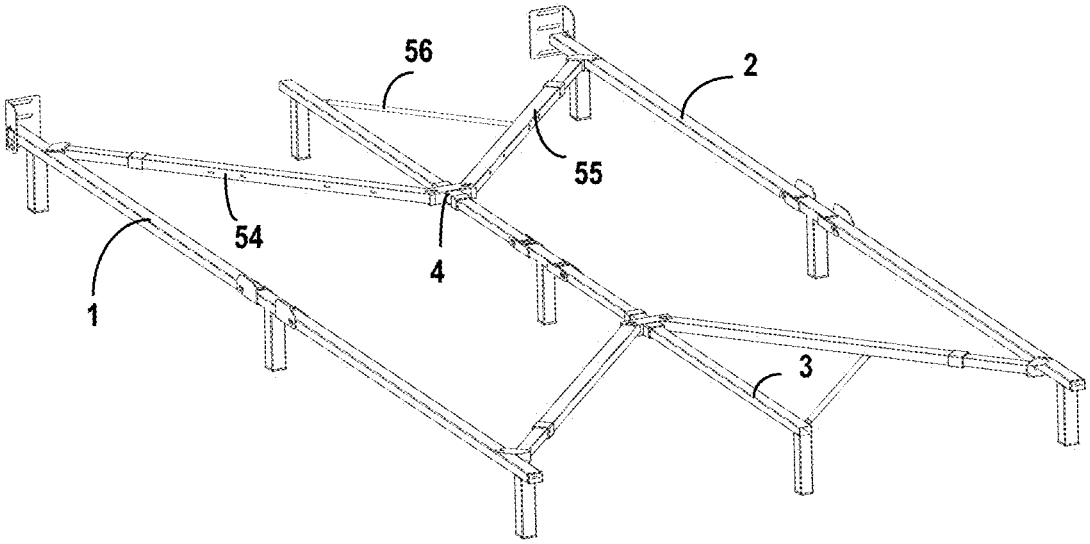
FIG. 15 is a schematic view of a bed frame of a third embodiment of the present disclosure.
Figure 16:
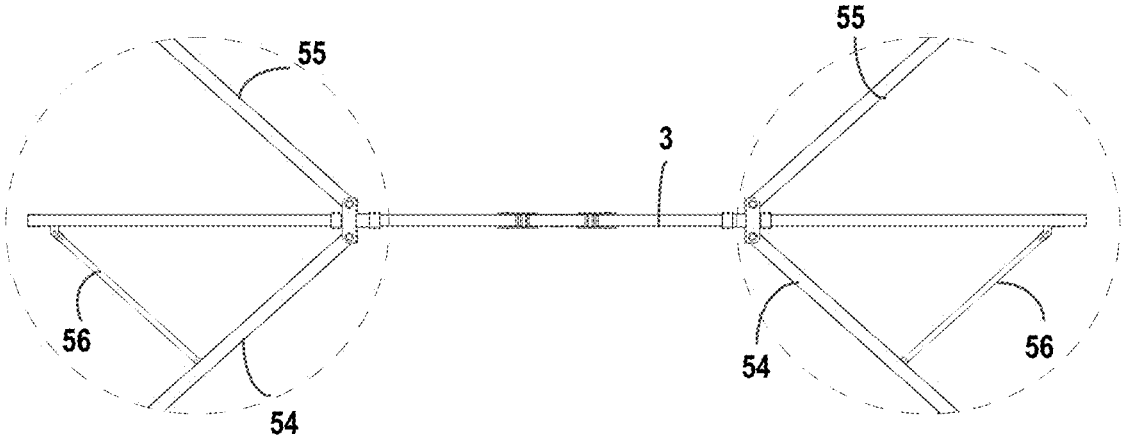
FIG. 16 through FIG. 18 are several alternative structures of FIG. 15.

In the solutions shown in FIG. 15 and FIG. 16, there are two additional links 56 which are located on the same side relative to the intermediate longitudinal support bar 3. In FIG. 15, the two additional links 56 are respectively connected to two right connecting rods 55 (i.e., connecting rods between the right longitudinal support bar 2 and the intermediate longitudinal support bar 3); in FIG. 16, the two additional links 56 are respectively connected to two left connecting rods 54 (i.e., connecting rods between the left longitudinal support bar 1 and the intermediate longitudinal support bar 3).

Figure 17:
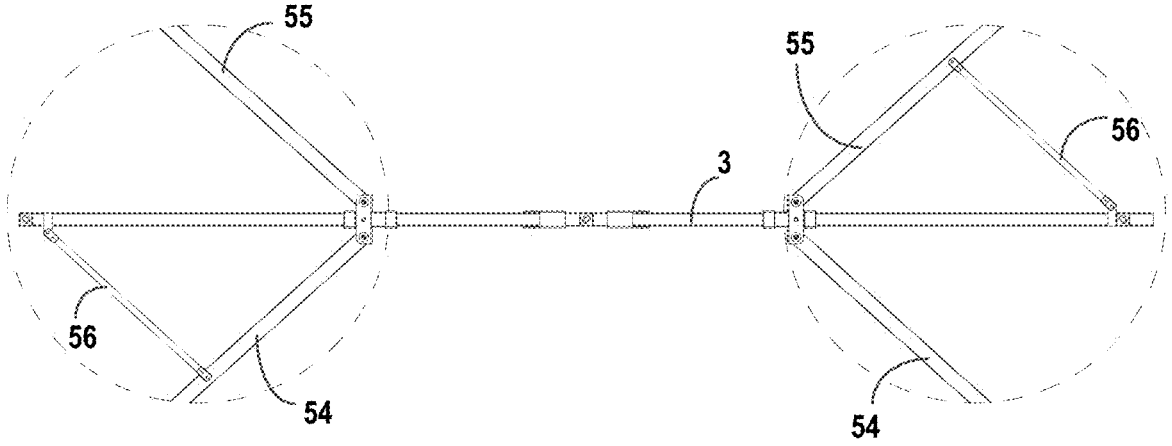

In the solution shown in FIG. 17, there are two additional links 56 which are located on different sides relative to the intermediate longitudinal support bar 3, and the two additional links 56 are respectively connected to the opposed ends of the intermediate longitudinal support bar 3. It can be seen from FIG. 17, the two additional links 56 are located on both lateral sides of the bed frame, one is connected to the left connecting rod 54, and the other is connected to the right connecting rod 55.

Figure 18:
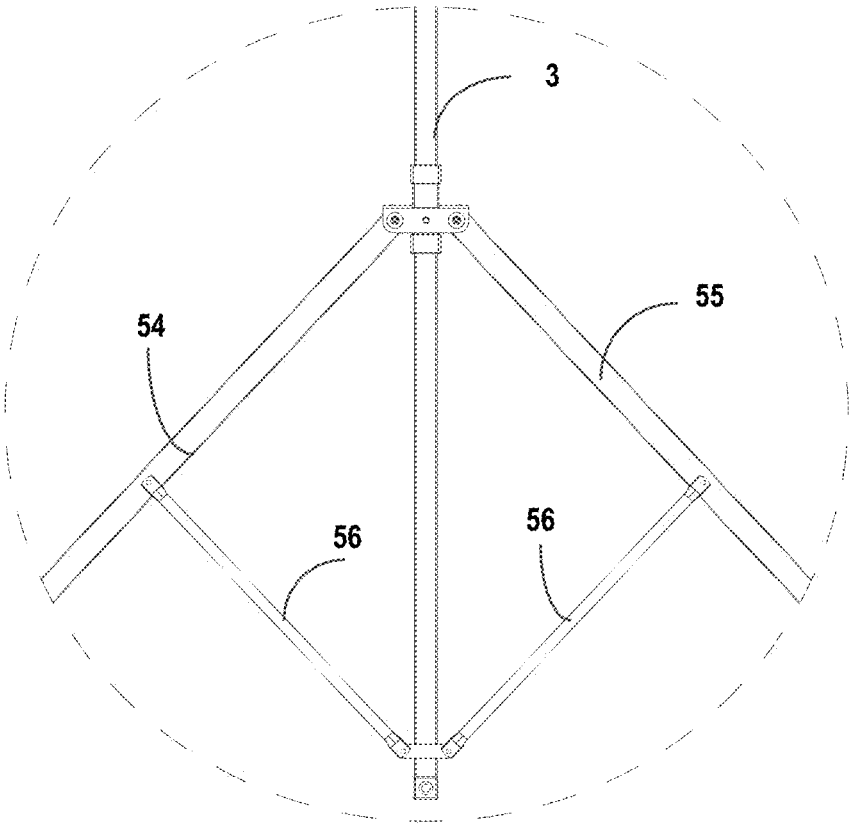

In another solution, there may be four additional links 56 which are connected one to one with the four connecting rods. FIG. 18 shows the structure at one transverse end of the bed frame in this solution, and two additional links 56 are connected to the left connecting rod 54 and the right connecting rod 55, respectively. It may be understood that the structure at the other transverse end of the bed frame is substantially similar to the structure shown in FIG. 18.

In other embodiments not shown, it is also possible to additionally provide additional links on the basis of the bed frame of the second embodiment. Specifically, the bed frame may further comprise at least two additional links extending between the left longitudinal support bar and the connecting rod or between the right longitudinal support bar and the connecting rod, one end of each additional link is pivotally attached to one end of the left longitudinal support bar or right longitudinal support bar, the other end is pivotally connected to the connecting rod, and, the additional links can be driven to move in the horizontal plane when the connecting rod moves in the horizontal plane.

The additional links may also be arranged in many ways. For example, there are two additional links, and the two additional links are located on the same side relative to the intermediate longitudinal support bar; or the two additional links are located on different sides relative to the intermediate longitudinal support bar.

Preferably, the two additional links are located on different sides relative to the intermediate longitudinal support bar, and one end of each of the two additional links is connected to an opposed end of the intermediate longitudinal support bar.

Or, there are four additional links which may be connected one to one with the four connecting rods.

The provision of the additional links can reinforce the strength of the bed frame; especially when the bed frame is in a semi-unfolded state, the additional links can function to assist in supporting. Moreover, the provision of the additional links can also enable more firm and stable connection between the intermediate longitudinal support bar and the left longitudinal support bar and the right longitudinal support bar.

In the bed frame provided by the present disclosure, the support bars for bearing weight are connected via the connecting rods, the connecting rods are driven to move by enabling an end of the connecting rods to slide on the support bars, thereby achieving the unfolding or folding of the bed frame. Such arrangement can enable quick and effective folding of the bed frame. The space occupied by the folded bed frame is small. The folding process is relatively simple and easy to implement. Furthermore, the bed frame exhibits better strength and stability. In either the deployed state or collapsed state, the bed frame can bear a larger weight and can satisfy many demands of the user.

LISTING OF PARTS DESIGNATED BY REFERENCE NUMBERS

Left longitudinal support bar 1
Right longitudinal support bar 2
Intermediate longitudinal support bar 3
Sliding sleeve 4
Connecting rod 5
First main body section 11
Second main body section 13
Intermediate section 12
Connecting sheet 14
Support bar pivot shaft 15
Slot 16
Leg 8
Receiving hole 41
Rack 42
Meshing plate 52
Gear structure 521
Ball end leaf spring 53
Protrusion 531
Round pin 61
Square pin 62
Upper plate 711
Lower plate 712
Pivot shat 725
Bearing frame 715
Retaining plate 724
Upper side plate 721
Lower side plate 723
Connecting portion 722
First bushing 51
Second bushing 52
Third bushing 53
Tongue member 9
Tongue 91
Left connecting rod 54
Right connecting rod 55
Additional link 56

Additional Embodiments

The following are additional embodiments, beginning with embodiment No. 21 as listed below:

21. A bed frame, comprising:

a left longitudinal support bar and a right longitudinal support bar which are located on both lateral sides of the bed frame respectively and extend in a longitudinal direction of the bed frame;

an intermediate longitudinal support bar disposed between the left longitudinal support bar and the right longitudinal support bar and extending in the longitudinal direction of the bed frame, wherein the bed frame further comprises:

four sliding sleeves, wherein two sliding sleeves are disposed spaced apart on the left longitudinal support bar and capable of sliding on the left longitudinal support bar, and the other two sliding sleeves are disposed spaced apart on the right longitudinal support bar and capable of sliding on the right longitudinal support bar, wherein a bracket is disposed on the sliding sleeve; and four connecting rods comprising two left connecting rods extending between the left longitudinal support bar and the intermediate longitudinal support bar and two right connecting rods extending between the right longitudinal support bar and the intermediate longitudinal support bar, wherein one end of each of the connecting rods is pivotally attached to an end of the intermediate longitudinal support bar about a pivot shaft, and the other end of the connecting rod is pivotally attached to the corresponding bracket, wherein the connecting rod is configured in a way that the end of the connecting rod mounted on the bracket moves along with the sliding sleeve when the sliding sleeve slides along the left longitudinal support bar or right longitudinal support bar, thereby driving the connecting rod to move on a horizontal plane such that the bed frame is in an unfolded state or a folded state.

22. The bed frame according to claim 21, wherein when the sliding sleeves slide toward each other along the left longitudinal support bar or right longitudinal support bar, the bed frame is gradually folded until the bed frame gets into the folded state in which the left longitudinal support bar, the right longitudinal support bar, the intermediate longitudinal support bar and the connecting rods abut against one another; when the sliding sleeves slide away from each other along the left longitudinal support bar or right longitudinal support bar, the bed frame is gradually unfolded until the bed frame gets into a state in which the respective connecting rods are perpendicular to the left longitudinal support bar, the right longitudinal support bar and the intermediate longitudinal support bar, respectively.

23. The bed frame according to claim 21, wherein a pin hole is disposed on the left longitudinal support bar or right longitudinal support bar at positions close to its end portions and middle portion, respectively, a pin is disposed in the pin hole, and the pin is configured to extend out of the pin holes under the action of an elastic force and retract back into the pin holes when subjected to pressure.

24. The bed frame according to claim 23, wherein a pin hole is also disposed on a middle position between the end portions and the middle portion, a pin is disposed in the pin hole, and the pin is configured to extend out of the pin holes under the action of an elastic force and retract back into the pin holes when subjected to pressure.

25. The bed frame according to claim 24, wherein a receiving hole is disposed on a side of the sliding sleeve facing the pin hole, wherein the receiving hole is configured in a way that when the receiving hole is aligned with the pin, the pin can extend out under the action of its elasticity, and automatically enter the receiving hole to lock the sliding sleeve on the corresponding left longitudinal support bar or right longitudinal support bar.

26. The bed frame according to claim 25, wherein the pin holes at the end portions of the left longitudinal support bar or right longitudinal support bar are positioned in a way that the connecting rods are perpendicular to the intermediate longitudinal support bar when the connecting rods are locked on the left longitudinal support bar or right longitudinal support bar; the pin hole at the middle portion of left longitudinal support bar or right longitudinal support bar is positioned in a way that when the connecting rods are locked, the connecting rods and the intermediate longitudinal support bar abut against one another side by side; the pin hole at a transition position of left longitudinal support bar or right longitudinal support bar is positioned in a way that when the connecting rods are locked, an angle between the connecting rods and the intermediate longitudinal support bar is an acute angle so that a width of the bed frame is adapted for dimension requirements of a twin size bed.

27. The bed frame according to claim 23, wherein the pin is a square pin or a round pin.

28. The bed frame according to claim 23, wherein the pin holes are provided on an upper surface and/or a lower surface of the left longitudinal support bar or the right longitudinal support bar.

29. The bed frame according to claim 21, wherein the bracket is mounted on the sliding sleeve, and the bracket is provided with a pivot shaft located on both lateral sides of the sliding sleeve and extending in a vertical direction, and the connecting rod is pivotally connected to the bracket via the pivot shaft.

30. The bed frame according to claim 29, wherein the bracket comprises an upper plate mounted on an upwardly facing surface of the sliding sleeve and a lower plate fixedly mounted on a downwardly facing surface of the sliding sleeve, both lateral sides of the upper plate and lower plate respectively extend out of the sliding sleeve to form cantilevers, and the pivot shafts are connected between the cantilevers on the same side of the upper plate and lower plate.

31. The bed frame according to claim 30, wherein the upper plate comprises two horizontal meshing plates which are respectively connected to two pivot shafts located on both lateral sides of the sliding sleeve, the meshing plates are in a sector shape and provided with a gear structure on an arcuate edge thereof, the gear structures of the two upper plates connected to one sliding sleeve face each other and can mesh with each other, thereby enabling synchronous rotation of the two connecting rods connected to the sliding sleeve.

32. The bed frame according to claim 29, wherein an end of the connecting rod connected to the sliding sleeve has an upper side plate and a lower side plate which extend in the horizontal direction and face each other, and the pivot shaft is located between the upper side plate and the lower side plate, and the bracket includes a bearing frame and a retaining plate, the bearing frame is fixedly mounted on a lower side of the sliding sleeve and extending laterally relative to the sliding sleeve to be supported below the lower side plate, and the retaining plate is positioned above the lower side plate to achieve limitation of the end of the connecting rod connected to the sliding sleeve in the vertical direction.

33. The bed frame according to claim 32, wherein the upper side plate is formed as a partially circular shape, an edge of the circular shape is formed as a gear structure, a rack extending in the longitudinal direction is disposed on both lateral upper edges of the sliding sleeve respectively, the gear structures of two connecting rods connected to one sliding sleeve can respectively mesh with respective racks so that the two connecting rods connected to the sliding sleeve can rotate synchronously.

34. The bed frame according to claim 21, wherein the left longitudinal support bar, the right longitudinal support bar and the intermediate longitudinal support bar respectively comprise two main body sections and an intermediate section connected between the two main body sections, the main body sections and the intermediate section are connected via a connecting sheet, a support bar pivot shaft is mounted on the connecting sheet, the two main body sections are configured to be capable of rotating relative to each other about their respective support bar pivot shafts in a vertical plane relative to the intermediate section so that the bed frame is folded or unfolded in the vertical plane.

35. The bed frame according to claim 34, wherein the bed frame further comprises a locking mechanism for locking the main body sections relative to the intermediate section when the main body sections rotate to the folded or unfolded position in the vertical plane.

36. The bed frame according to claim 21, wherein the connecting rod comprises a plurality of bushing rods which are nested one inside another so that the connecting rod is telescopic in its extension direction.

37. The bed frame according to claim 36, wherein in any two adjacent bushing rods, one bushing rod is provided with a first alignment hole, a ball end leaf spring with a protrusion is disposed in the first alignment hole, the ball end leaf spring is configured to extend out of the first alignment hole under action of an elastic force and retract back into the first alignment hole when subjected to a pressure, the other bushing rod is nested around a preceding bushing rod, a second alignment hole is disposed on a side face of the other bushing rod facing the first alignment hole, the second alignment hole is configured in a way that when the second alignment hole aligns with the protrusion, the protrusion can extend out under the action of elasticity, automatically enter the second alignment hole and thereby lock the two adjacent bushing rods relative to one another.

38. The bed frame according to claim 21, wherein the bed frame is configured to be engageable with a tongue member for mounting a bedhead member, the tongue member comprises a tongue, an upwardly open slot is provided at the end of the left longitudinal support bar and right longitudinal support bar, and the slot is configured to receive the tongue.

39. The bed frame according to claim 21, wherein the left longitudinal support bar, the right longitudinal support bar, and the intermediate longitudinal support bar are respectively provided with downwardly extending legs at both ends and in the middle.

40. The bed frame according to claim 39, wherein the legs are also pivotally connected to respective longitudinal support bars, the legs are rotatable and foldable relative to the respective longitudinal support bars, and in the folded state the legs abut against the respective longitudinal support bars side by side.

41. A bed frame, comprising:

a left longitudinal support bar and a right longitudinal support bar which are located on both lateral sides of the bed frame respectively and extend in a longitudinal direction of the bed frame;

an intermediate longitudinal support bar disposed between the left longitudinal support bar and the right longitudinal support bar and extending in the longitudinal direction of the bed frame, wherein the bed frame further comprises:

two spaced-apart sliding sleeves disposed on the intermediate longitudinal support bar and being slidable on the intermediate longitudinal support bar, wherein a bracket is disposed on the sliding sleeve; and four connecting rods comprising two left connecting rods extending between the left longitudinal support bar and the intermediate longitudinal support bar and two right connecting rods extending between the right longitudinal support bar and the intermediate longitudinal support bar, wherein one end of each of the connecting rods is pivotally attached to an end of the left longitudinal support bar or the right longitudinal support bar, and the other end of the connecting rod is pivotally attached to the corresponding bracket, wherein the connecting rod is configured in a way that the end of the connecting rod mounted on the bracket moves along with the sliding sleeve when the sliding sleeve slides along the intermediate longitudinal support bar, thereby driving the connecting rod to move on a horizontal plane such that the bed frame is in an unfolded state or a folded state; and wherein the bed frame further comprises at least two additional links extending between the intermediate longitudinal support bar and the connecting rods, one end of each of the additional links is pivotally connected to one end of the intermediate longitudinal support bar, the other end is pivotally connected to the connecting rod, and when the connecting rod moves in a horizontal plane, the additional link can be driven by the connecting rod to move in a horizontal plane.

42. The bed frame according to claim 41, wherein the additional links comprise two additional links, and the two additional links are located on the same side relative to the intermediate longitudinal support bar; or the additional links comprise two additional links, and the two additional links are located on different sides relative to the intermediate longitudinal support bar.

43. The bed frame according to claim 42, wherein the additional links comprise two additional links, and the two additional links are located on different sides relative to the intermediate longitudinal support bar, and one ends of the two additional links are respectively connected to opposing ends of the intermediate longitudinal support bar.

44. The bed frame according to claim 41, wherein the additional links comprise four additional links 45. The bed frame according to claim 41, wherein when the sliding sleeves slide toward each other along the intermediate longitudinal support bar, the bed frame is gradually folded until the bed frame gets into the folded state in which the left longitudinal support bar, the right longitudinal support bar, the intermediate longitudinal support bar and the connecting rods abut against one another; when the sliding sleeves slide away from each other along the intermediate longitudinal support bar, the bed frame is gradually unfolded until the bed frame gets into a state in which the respective connecting rods are perpendicular to the left longitudinal support bar, the right longitudinal support bar and the intermediate longitudinal support bar, respectively.

46. The bed frame according to claim 41, wherein the intermediate longitudinal support bar is provided with a pin hole at positions close to its end portions and middle portion respectively, a pin is disposed in the pin hole, and the pin is configured to extend out of the pin hole under the action of an elastic force and retract back into the pin hole when subjected to pressure.

47. The bed frame according to claim 44, wherein a pin hole is also disposed on a middle position between the end portions and the middle portion, a pin is disposed in the pin hole, and the pin is configured to extend out of the pin holes under the action of an elastic force and retract back into the pin holes when subjected to pressure.

48. The bed frame according to claim 45, wherein a receiving hole is disposed on a side of the sliding sleeve facing the pin hole, wherein the receiving hole is configured in a way that when the receiving hole is aligned with the pin, the pin can extend out under the action of its elasticity, and automatically enter the receiving hole to lock the sliding sleeve on the intermediate longitudinal support bar.

49. The bed frame according to claim 46, wherein the pin holes at the end portions of the intermediate longitudinal support bar are positioned in a way that the connecting rods are perpendicular to the intermediate longitudinal support bar when the connecting rods are locked on the intermediate longitudinal support bar; the pin hole at the middle portion of the intermediate longitudinal support bar is positioned in a way that when the connecting rods are locked, the connecting rods and the intermediate longitudinal support bar abut against one another side by side; the pin hole at the middle position of the intermediate longitudinal support rod is positioned in a way that when the connecting rods are locked, an angle between the connecting rods and the intermediate longitudinal support bar is an acute angle so that a width of the bed frame is adapted for dimension requirements of a twin size bed.

50. The bed frame according to claim 46, wherein the pin is a square pin or a round pin.

51. The bed frame according to claim 46, wherein the pin holes are provided on an upper surface and/or a lower surface of the intermediate longitudinal support bar.

52. The bed frame according to claim 41, wherein the bracket is mounted on the sliding sleeve, and the bracket is provided with a pivot shaft located on both lateral sides of the sliding sleeve and extending in a vertical direction, and the connecting rod is pivotally connected to the bracket via the pivot shaft.

53. The bed frame according to claim 50, wherein the bracket comprises an upper plate mounted on an upwardly facing surface of the sliding sleeve and a lower plate fixedly mounted on a downwardly facing surface of the sliding sleeve, both lateral sides of the upper plate and lower plate respectively extend out of the sliding sleeve to form cantilevers, and the pivot shafts are connected between the cantilevers on the same side of the upper plate and lower plate.

54. The bed frame according to claim 51, wherein the upper plate comprises two horizontal meshing plates which are respectively connected to two pivot shafts located on both lateral sides of the sliding sleeve, the meshing plates are in a sector shape and provided with a gear structure on an arcuate edge thereof, the gear structures of the two upper plates connected to one sliding sleeve face each other and can mesh with each other, thereby enabling synchronous rotation of the two connecting rods.

55. The bed frame according to claim 52, wherein an end of the connecting rod connected to the sliding sleeve has an upper side plate and a lower side plate which extend in the horizontal direction and face each other, and the pivot shaft is located between the upper side plate and the lower side plate, and the bracket includes a bearing frame and a retaining plate, the bearing frame is fixedly mounted on a lower side of the sliding sleeve and extending laterally relative to the sliding sleeve to be supported below the lower side plate, and the retaining plate is positioned above the lower side plate to achieve limitation of the end of the connecting rod connected to the sliding sleeve in the vertical direction.

56. The bed frame according to claim 53, wherein the upper side plate is formed as a partially circular shape, an edge of the circular shape is formed as a gear structure, a rack extending in the longitudinal direction is disposed on both lateral upper edges of the sliding sleeve respectively, the gear structures of two connecting rods connected to one sliding sleeve can respectively mesh with respective racks so that the two connecting rods connected to the sliding sleeve can rotate synchronously.

57. The bed frame according to claim 41, wherein the left longitudinal support bar, the right longitudinal support bar and the intermediate longitudinal support bar respectively comprise two main body sections and an intermediate section connected between the two main body sections, the main body sections and the intermediate section are connected via a connecting sheet, a support bar pivot shaft is mounted on the connecting sheet, the two main body sections are configured to be capable of rotating relative to each other about their respective support bar pivot shafts in a vertical plane relative to the intermediate section so that the bed frame is folded or unfolded in the vertical plane.

58. The bed frame according to claim 55, wherein the bed frame further comprises a locking mechanism for locking the main body sections relative to the intermediate section when the main body sections rotate to the folded or unfolded position in the vertical plane.

59. The bed frame according to claim 41, wherein the connecting rod comprises a plurality of bushing rods which are nested one inside another so that the connecting rod is telescopic in its extension direction.

60. The bed frame according to claim 57, wherein in any two adjacent bushing rods, one bushing rod is provided with a first alignment hole, a ball end leaf spring with a protrusion is disposed in the first alignment hole, the ball end leaf spring is configured to extend out of the first alignment hole under action of an elastic force and retract back into the first alignment hole when subjected to a pressure, the other bushing rod is nested around a preceding bushing rod, a second alignment hole is disposed on a side face of the other bushing rod facing the first alignment hole, the second alignment hole is configured in a way that when the second alignment hole aligns with the protrusion, the protrusion can extend out under the action of elasticity, automatically enter the second alignment hole and thereby lock the two adjacent bushing rods relative to one another.

61. The bed frame according to claim 41, wherein the bed frame is configured to be engageable with a tongue member for mounting a bedhead member, the tongue member comprises a tongue, an upwardly open slot is provided at the end of the left longitudinal support bar and right longitudinal support bar, and the slot is configured to receive the tongue.

62. The bed frame according to claim 41, wherein the left longitudinal support bar, the right longitudinal support bar, and the intermediate longitudinal support bar are respectively provided with downwardly extending legs at both ends and in the middle.

63. The bed frame according to claim 60, wherein the legs are also pivotally connected to respective longitudinal support bars, the legs are rotatable and foldable relative to the respective longitudinal support bars, and in the folded state the legs abut against the respective longitudinal support bars side by side.

64. A bed frame, comprising:

a left longitudinal support bar and a right longitudinal support bar which are located on both lateral sides of the bed frame respectively and extend in a longitudinal direction of the bed frame;

an intermediate longitudinal support bar disposed between the left longitudinal support bar and the right longitudinal support bar and extending in the longitudinal direction of the bed frame, wherein the bed frame further comprises:

four sliding sleeves, wherein two sliding sleeves are disposed spaced apart on the left longitudinal support bar and capable of sliding on the left longitudinal support bar, and the other two sliding sleeves are disposed spaced apart on the right longitudinal support bar and capable of sliding on the right longitudinal support bar, wherein a bracket is disposed on the sliding sleeve; and four connecting rods comprising two left connecting rods extending between the left longitudinal support bar and the intermediate longitudinal support bar and two right connecting rods extending between the right longitudinal support bar and the intermediate longitudinal support bar, wherein one end of each of the connecting rods is pivotally attached to an end of the intermediate longitudinal support bar about a pivot shaft, and the other end of the connecting rod is pivotally attached to the corresponding bracket, wherein the connecting rod is configured in a way that the end of the connecting rod mounted on the bracket moves along with the sliding sleeve when the sliding sleeve slides along the left longitudinal support bar or right longitudinal support bar, thereby driving the connecting rod to move on a horizontal plane such that the bed frame is in an unfolded state or a folded state; and wherein the bed frame further comprises at least two additional links extending between the left longitudinal support bar and the connecting rods or between the right longitudinal support bar and the connecting rods, one end of each of the additional links is pivotally connected to one end of the left longitudinal support bar or the right longitudinal support bar, the other end is pivotally connected to the connecting rod, and when the connecting rod moves in a horizontal plane, the additional link can be driven by the connecting rod to move in a horizontal plane.

65. The bed frame according to claim 64, wherein the additional links comprise two additional links, and the two additional links are located on the same side relative to the intermediate longitudinal support bar; or the additional links comprise two additional links, and the two additional links are located on different sides relative to the intermediate longitudinal support bar.

66. The bed frame according to claim 65, wherein the additional links comprise two additional links, and the two additional links are located on different sides relative to the intermediate longitudinal support bar, and one ends of the two additional links are respectively connected to opposing ends of the intermediate longitudinal support bar.

67. The bed frame according to claim 64, wherein the additional links comprise four additional links.

68. The bed frame according to claim 64, wherein when the sliding sleeves slide toward each other along the left longitudinal support bar or right longitudinal support bar, the bed frame is gradually folded until the bed frame gets into the folded state in which the left longitudinal support bar, the right longitudinal support bar, the intermediate longitudinal support bar and the connecting rods abut against one another; when the sliding sleeves slide away from each other along the left longitudinal support bar or right longitudinal support bar, the bed frame is gradually unfolded until the bed frame gets into a state in which the respective connecting rods are perpendicular to the left longitudinal support bar, the right longitudinal support bar and the intermediate longitudinal support bar, respectively.

69. The bed frame according to claim 64, wherein the left longitudinal support bar or right longitudinal support bar is provided with a pin hole at positions close to its end portions and middle portion respectively and at a transition position between the end portions and the middle portion, respectively, a pin is disposed in the pin hole, and the pin is configured to extend out of the pin hole under the action of an elastic force and retract back into the pin hole when subjected to pressure.

70. The bed frame according to claim 69, wherein a pin hole is also disposed on a middle position between the end portions and the middle portion, a pin is disposed in the pin hole, and the pin is configured to extend out of the pin holes under the action of an elastic force and retract back into the pin holes when subjected to pressure.

71. The bed frame according to claim 70, wherein a receiving hole is disposed on a side of the sliding sleeve facing the pin hole, wherein the receiving hole is configured in a way that when the receiving hole is aligned with the pin, the pin can extend out under the action of its elasticity, and automatically enter the receiving hole to lock the sliding sleeve on the left longitudinal support bar or right longitudinal support bar.

72. The bed frame according to claim 71, wherein the pin holes at the end portions of the left longitudinal support bar or right longitudinal support bar are positioned in a way that the connecting rods are perpendicular to the intermediate longitudinal support bar when the connecting rods are locked on the left longitudinal support bar or right longitudinal support bar; the pin hole at the middle portion of left longitudinal support bar or right longitudinal support bar is positioned in a way that when the connecting rods are locked, the connecting rods and the intermediate longitudinal support bar abut against one another side by side; the pin hole at a transition position of left longitudinal support bar or right longitudinal support bar is positioned in a way that when the connecting rods are locked, an angle between the connecting rods and the intermediate longitudinal support bar is an acute angle so that a width of the bed frame is adapted for dimension requirements of a twin size bed.

73. The bed frame according to claim 69, wherein the pin is a square pin or a round pin.

74. The bed frame according to claim 69, wherein the pin holes are provided on an upper surface and/or a lower surface of the left longitudinal support bar or the right longitudinal support bar.

75. The bed frame according to claim 64, wherein the bracket is mounted on the sliding sleeve, and the bracket is provided with a pivot shaft located on both lateral sides of the sliding sleeve and extending in a vertical direction, and the connecting rod is pivotally connected to the bracket via the pivot shaft.

76. The bed frame according to claim 75, wherein the bracket comprises an upper plate mounted on an upwardly facing surface of the sliding sleeve and a lower plate fixedly mounted on a downwardly facing surface of the sliding sleeve, both lateral sides of the upper plate and lower plate respectively extend out of the sliding sleeve to form cantilevers, and the pivot shafts are connected between the cantilevers on the same side of the upper plate and lower plate.

77. The bed frame according to claim 76, wherein the upper plate comprises two horizontal meshing plates which are respectively connected to two pivot shafts located on both lateral sides of the sliding sleeve, the meshing plates are in a sector shape and provided with a gear structure on an arcuate edge thereof, the gear structures of the two upper plates connected to one sliding sleeve face each other and can mesh with each other, thereby enabling synchronous rotation of the two connecting rods connected to the sliding sleeve.

78. The bed frame according to claim 75, wherein an end of the connecting rod connected to the sliding sleeve has an upper side plate and a lower side plate which extend in the horizontal direction and face each other, and the pivot shaft is located between the upper side plate and the lower side plate, and the bracket includes a bearing frame and a retaining plate, the bearing frame is fixedly mounted on a lower side of the sliding sleeve and extending laterally relative to the sliding sleeve to be supported below the lower side plate, and the retaining plate is positioned above the lower side plate to achieve limitation of the end of the connecting rod connected to the sliding sleeve in the vertical direction.

79. The bed frame according to claim 78, wherein the upper side plate is formed as a partially circular shape, an edge of the circular shape is formed as a gear structure, a rack extending in the longitudinal direction is disposed on both lateral upper edges of the sliding sleeve respectively, the gear structures of two connecting rods connected to one sliding sleeve can respectively mesh with respective racks so that the two connecting rods connected to the sliding sleeve can rotate synchronously.

80. The bed frame according to claim 64, wherein the left longitudinal support bar, the right longitudinal support bar and the intermediate longitudinal support bar respectively comprise two main body sections and an intermediate section connected between the two main body sections, the main body sections and the intermediate section are connected via a connecting sheet, a support bar pivot shaft is mounted on the connecting sheet, the two main body sections are configured to be capable of rotating relative to each other about their respective support bar pivot shafts in a vertical plane relative to the intermediate section so that the bed frame is folded or unfolded in the vertical plane.

81. The bed frame according to claim 80, wherein the bed frame further comprises a locking mechanism for locking the main body sections relative to the intermediate section when the main body sections rotate to the folded or unfolded position in the vertical plane.

82. The bed frame according to claim 64, wherein the connecting rod comprises a plurality of bushing rods which are nested one inside another so that the connecting rod is telescopic in its extension direction.

83. The bed frame according to claim 82, wherein in any two adjacent bushing rods, one bushing rod is provided with a first alignment hole, a ball end leaf spring with a protrusion is disposed in the first alignment hole, the ball end leaf spring is configured to extend out of the first alignment hole under action of an elastic force and retract back into the first alignment hole when subjected to a pressure, the other bushing rod is nested around a preceding bushing rod, a second alignment hole is disposed on a side face of the other bushing rod facing the first alignment hole, the second alignment hole is configured in a way that when the second alignment hole aligns with the protrusion, the protrusion can extend out under the action of elasticity, automatically enter the second alignment hole and thereby lock the two adjacent bushing rods relative to one another.

84. The bed frame according to claim 64, wherein the bed frame is configured to be engageable with a tongue member for mounting a bedhead member, the tongue member comprises a tongue, an upwardly open slot is provided at the end of the left longitudinal support bar and right longitudinal support bar, and the slot is configured to receive the tongue.

85. The bed frame according to claim 64, wherein the left longitudinal support bar, the right longitudinal support bar, and the intermediate longitudinal support bar are respectively provided with downwardly extending legs at both ends and in the middle.

86. The bed frame according to claim 85, wherein the legs are also pivotally connected to respective longitudinal support bars, the legs are rotatable and foldable relative to the respective longitudinal support bars, and in the folded state the legs abut against the respective longitudinal support bars side by side.

The above depictions of various embodiments of the present disclosure are provided to those having ordinary skill in the art for depiction purpose, and are not intended to exclude other embodiments from the present disclosure or limit the present disclosure to a single disclosed embodiment. As described above, various alternatives and modifications of the present disclosure will be apparent to those of ordinary skill in the art. Accordingly, although some alternative embodiments have been described in detail, those having ordinary skill in the art will understand or readily develop other embodiments. The disclosure is intended to cover all alternatives, modifications and variations of the present disclosure described herein, as well as other embodiments falling within the spirit and scope of the present disclosure described herein.

What is claimed is:

1. A bed frame, comprising:

a left longitudinal support bar and a right longitudinal support bar which are located on lateral sides of the bed frame respectively and extend in a longitudinal direction of the bed frame;

an intermediate longitudinal support bar disposed between the left longitudinal support bar and the right longitudinal support bar and extending in the longitudinal direction of the bed frame, wherein the bed frame further comprises:

two spaced-apart sliding sleeves disposed on the intermediate longitudinal support bar and being slidable on the intermediate longitudinal support bar;

a bracket disposed on each sliding sleeve;

two left connecting rods extending between the left longitudinal support bar and the intermediate longitudinal support bar and two right connecting rods extending between the right longitudinal support bar and the intermediate longitudinal support bar, wherein an outer end of each of the connecting rods is pivotally attached to an end of the left longitudinal support bar or the right longitudinal support bar, and an inner end of the connecting rod is pivotally attached to the corresponding bracket;

wherein the connecting rods are configured in a way that the end of the connecting rod mounted on the bracket moves along with the sliding sleeve when the sliding sleeve slides along the intermediate longitudinal support bar, thereby driving the connecting rod to move on a horizontal plane such that the bed frame is moved into an unfolded state or a folded state;

each bracket having a vertical pivot shaft located on both lateral sides of the sliding sleeve with each connecting rod pivotally connected to the bracket via the pivot shaft;

each bracket comprises an upper plate on an upwardly facing surface of the sliding sleeve and a lower plate fixedly mounted on a downwardly facing surface of the sliding sleeve, both sides of the upper plate and lower plate respectively extending laterally out from the sliding sleeve to form cantilevers, the pivot shafts are connected between the cantilevers; and the upper plate comprising two horizontal meshing plates, each horizontal meshing plate connected to one of the vertical pivot shafts, each meshing plate having a sector shape and a gear structure on an arcuate edge the meshing plate, the gear structures of the upper plates meshing with each other, thereby enabling synchronous rotation of the connecting rods.

2. The bed frame according to claim 1, wherein when the sliding sleeves slide toward each other along the intermediate longitudinal support bar, the bed frame is gradually folded until the bed frame gets into the folded state in which the left longitudinal support bar, the right longitudinal support bar, the intermediate longitudinal support bar and the connecting rods abut against one another; when the sliding sleeves slide away from each other along the intermediate longitudinal support bar, the bed frame is gradually unfolded until the bed frame gets into a state in which the respective connecting rods are perpendicular to the left longitudinal support bar, the right longitudinal support bar and the intermediate longitudinal support bar, respectively.

3. The bed frame according to claim 1, wherein the intermediate longitudinal support bar is provided with a pin hole adjacent to its end portions and middle portion respectively, a pin is disposed in each pin hole, and the pin is configured to extend out of the pin hole by elastic force and retract back into the pin hole when subjected to pressure.

4. The bed frame according to claim 3, wherein a receiving hole is disposed on a side of the sliding sleeve facing the pin hole, wherein the receiving hole is configured in a way that when the receiving hole is aligned with the pin, the pin can extend out under the action of its elasticity, and automatically enter the receiving hole to lock the sliding sleeve on the intermediate longitudinal support bar.

5. The bed frame according to claim 3 wherein the connecting rods are perpendicular to the intermediate longitudinal support bar when one or both of the sliding sleeves is locked on the intermediate longitudinal support bar by the pin extending from the pin hole adjacent to the end portion of the intermediate longitudinal support bar;

the connecting rods and the intermediate longitudinal support bar abut against one another side by side when one or both of the sliding sleeves is locked on the intermediate longitudinal support bar by the pin extending from the pin hole at the middle portion of the intermediate longitudinal support bar; and the connecting rods are at an acute angle to the intermediate longitudinal support rod when one or both of the sliding sleeves is locked on the intermediate longitudinal support bar by a pin extending from a pin hole between the end and middle portions of the intermediate longitudinal support bar, so that a width of the bed frame is adapted for dimension requirements of a twin size bed.

6. The bed frame of claim 5 wherein any of the pins is a square pin or a round pin.

7. The bed frame of claim 5 wherein any of the pin holes are provided on an upper surface and/or a lower surface of the intermediate longitudinal support bar.

8. The bed frame according to claim 1 further including first and second pivot shafts on opposite sides of each sliding sleeve, each pivot shaft pivotally connecting one of the connecting rods to one of the brackets.

9. The bed frame according to claim 8, wherein each bracket comprises an upper plate mounted on an upwardly facing surface of the sliding sleeve and a lower plate fixedly mounted on a downwardly facing surface of the sliding sleeve, both lateral sides of the upper plate and lower plate respectively extend out of the sliding sleeve to form cantilevers, and the pivot shafts are connected between the cantilevers on the same side of the upper plate and lower plate.

10. The bed frame according to claim 9, wherein the upper plate comprises two horizontal meshing plates which are respectively connected to two pivot shafts located on both lateral sides of the sliding sleeve, the meshing plates are in a sector shape and provided with a gear structure on an arcuate edge thereof, the gear structures meshing with each other, thereby enabling synchronous rotation of the two connecting rods.

11. The bed frame according to claim 8, wherein a first end of the first left connecting rod has an upper side plate and a lower side plate which extend in the horizontal direction and face each other, and the pivot shaft is located between the upper side plate and the lower side plate, and each bracket includes a bearing frame and a retaining plate, the bearing frame is fixedly mounted on a lower side of the sliding sleeve and extending laterally relative to the sliding sleeve to be supported below the lower side plate, and the retaining plate is positioned above the lower side plate to limit movement of the first end of the connecting rod in the vertical direction.

12. The bed frame according to claim 11, wherein the upper side plate is formed as a partially circular shape, an edge of the circular shape is formed as a gear structure, a rack extending in the longitudinal direction is disposed on both lateral upper edges of the sliding sleeve respectively, the gear structures meshing with respective racks so that the two connecting rods rotate synchronously.

13. The bed frame according to claim 1, wherein each of the left longitudinal support bar, the right longitudinal support bar and the intermediate longitudinal support bar respectively comprise two main body sections and an intermediate section connected between the two main body sections, the main body sections and the intermediate section are connected via a connecting plate, a support bar pivot shaft is mounted on the connecting plate, the two main body sections are rotatable relative to each other about their respective support bar pivot shafts in a vertical plane relative to the intermediate section so that the bed frame is folded or unfolded in the vertical plane.

14. The bed frame according to claim 13 further comprising a locking pin for locking the main body sections relative to the intermediate section when the main body sections rotate to folded or unfolded position in the vertical plane.

15. The bed frame according to claim 1, wherein one or more of the connecting rods comprises a plurality of bushing rods which are nested one inside another so that the connecting rod is telescopic.

16. The bed frame according to claim 15, wherein in any two adjacent bushing rods, a first bushing rod is provided with a first alignment hole, a bulb leaf spring with a protrusion is disposed in the first alignment hole, the bulb leaf spring is configured to extend out of the first alignment hole under action of an elastic force and retract back into the first alignment hole when subjected to a pressure, and a second bushing rod is nested around the first bushing rod, a second alignment hole is disposed on a side face of the second bushing rod facing the first alignment hole, the second alignment hole is configured in a way that when the second alignment hole aligns with the protrusion, the protrusion can extend out under the action of elasticity, automatically enter the second alignment hole and thereby lock the two adjacent bushing rods relative to one another.

17. The bed frame according to claim 1, wherein the bed frame is configured to be engageable with a tongue member for mounting a bedhead member, the tongue member comprises a tongue, an upwardly open slot is provided at the end of the left longitudinal support bar and right longitudinal support bar, and the slot is configured to receive the tongue.

18. The bed frame according to claim 1, wherein the left longitudinal support bar, the right longitudinal support bar, and the intermediate longitudinal support bar are respectively provided with downwardly extending legs at both ends and in the middle.

19. The bed frame according to claim 18, wherein the legs are also pivotally connected to respective longitudinal support bars, the legs are rotatable and foldable relative to the respective longitudinal support bars, and in the folded state the legs abut against the respective longitudinal support bars side by side.

20. A bed frame, comprising:

a left longitudinal support bar and a right longitudinal support bar on lateral sides of the bed frame extending respectively in a longitudinal direction of the bed frame;

an intermediate longitudinal support bar disposed between the left longitudinal support bar and the right longitudinal support bar and extending in the longitudinal direction of the bed frame, wherein the bed frame further comprises:

two spaced-apart sliding sleeves disposed on the intermediate longitudinal support bar and being slidable on the intermediate longitudinal support bar, wherein each sliding sleeve has a bracket; and four connecting rods comprising two left connecting rods extending between the left longitudinal support bar and the intermediate longitudinal support bar and two right connecting rods extending between the right longitudinal support bar and the intermediate longitudinal support bar, wherein one end of each of the connecting rods is pivotally attached to an end of the left longitudinal support bar or the right longitudinal support bar, and the other end of the connecting rod is pivotally attached to the corresponding bracket;

wherein the connecting rod is configured in a way that the end of the connecting rod mounted on the bracket moves along with the sliding sleeve when the sliding sleeve slides along the intermediate longitudinal support bar, thereby driving the connecting rod to move on a horizontal plane such that the bed frame is in an unfolded state or a folded state;

wherein the bed frame further comprises at least two additional links extending between the intermediate longitudinal support bar and the connecting rods, one end of each of the additional links is pivotally connected to one end of the intermediate longitudinal support bar, the other end is pivotally connected to the connecting rod, and when the connecting rod moves in a horizontal plane, the additional link can be driven by the connecting rod to move in a horizontal plane;

a deployed position hole at an end portion of the intermediate longitudinal support bar positioned in a way that the connecting rods are perpendicular to the intermediate longitudinal support bar when a deployed position pin extends out of the deployed position hole to lock one of the sliding sleeves in position on the intermediate longitudinal support bar with the bed frame in a deployed state;

a collapsed position hole in the intermediate longitudinal support bar positioned in a way that the connecting rods and the intermediate longitudinal support bar abut against one another side by side when a collapsed position pin extends out of the collapsed position hole to lock one of the sliding sleeves in position on the intermediate longitudinal support bar with the bed frame in a collapsed state;

a twin-size position hole in the intermediate longitudinal support bar positioned in a way that the connecting rods are at an acute angle to the intermediate longitudinal support bar when a middle position pin extends out of the twin-size position hole to lock one of the sliding sleeves in position on the intermediate longitudinal support bar with the bed frame adapted for a twin size bed; and wherein each of the pins can extend out by elastic force and retract back when subjected to pressure.

21. The bed frame according to claim 20, wherein the additional links comprise two additional links, and the two additional links are located on the same side relative to the intermediate longitudinal support bar; or the additional links comprise two additional links, and the two additional links are located on different sides relative to the intermediate longitudinal support bar.

22. The bed frame according to claim 21, wherein the additional links comprise two additional links, and the two additional links are located on different sides relative to the intermediate longitudinal support bar, and said one ends of the two additional links are respectively connected to opposing ends of the intermediate longitudinal support bar.

23. The bed frame according to claim 20, wherein the additional links comprise four additional links.

24. The bed frame according to claim 20, wherein when the sliding sleeves slide toward each other along the intermediate longitudinal support bar, the bed frame is folded until the bed frame gets into the folded state in which the left longitudinal support bar, the right longitudinal support bar, the intermediate longitudinal support bar and the connecting rods abut against one another; when the sliding sleeves slide away from each other along the intermediate longitudinal support bar, the bed frame is unfolded until the bed frame gets into a state in which the respective connecting rods are perpendicular to the left longitudinal support bar, the right longitudinal support bar and the intermediate longitudinal support bar, respectively.

25. The bed frame according to claim 20, wherein a receiving hole on the sliding sleeve is configured in a way that when the receiving hole is aligned with one of the pins, the pin can extend out under the action of its elasticity, and automatically enter the receiving hole to lock the sliding sleeve on the intermediate longitudinal support bar.

26. The bed frame of claim 20 wherein one or more of the pins is a square pin or a round pin.

27. The bed frame of claim 20 wherein one or more of the position holes is on an upper surface and/or a lower surface of the intermediate longitudinal support bar.

28. The bed frame according to claim 20 further including first and second pivot shafts on opposite sides of each sliding sleeve, each pivot shaft pivotally connecting one of the connecting rods to one of the brackets.

29. The bed frame according to claim 28, wherein each bracket comprises an upper plate mounted on an upwardly facing surface of the sliding sleeve and a lower plate fixedly mounted on a downwardly facing surface of the sliding sleeve, both lateral sides of the upper plate and lower plate respectively extend out of the sliding sleeve to form cantilevers, and the pivot shafts are connected between the cantilevers on the same side of the upper plate and lower plate.

30. The bed frame according to claim 29, wherein the upper plate comprises two horizontal meshing plates which are respectively connected to two pivot shafts located on both lateral sides of the sliding sleeve, the meshing plates are in a sector shape and provided with a gear structure on an arcuate edge thereof, the gear structures of the two upper plates connected to one said sliding sleeve face each other and can mesh with each other, thereby enabling synchronous rotation of the two connecting rods.

31. The bed frame according to claim 28, wherein an end of the connecting rod connected to the sliding sleeve has an upper side plate and a lower side plate which extend in the horizontal direction and face each other, and the pivot shaft is located between the upper side plate and the lower side plate, and the bracket includes a bearing frame and a retaining plate, the bearing frame is fixedly mounted on a lower side of the sliding sleeve and extending laterally relative to the sliding sleeve to be supported below the lower side plate, and the retaining plate is positioned above the lower side plate to achieve limitation of the end of the connecting rod connected to the sliding sleeve in the vertical direction.

32. The bed frame according to claim 31, wherein the upper side plate is formed as a partially circular shape, an edge of the circular shape is formed as a gear structure, a rack extending in the longitudinal direction is disposed on both lateral upper edges of the sliding sleeve respectively, the gear structures of two connecting rods connected to one said sliding sleeve can respectively mesh with respective racks so that the two connecting rods connected to the sliding sleeve can rotate synchronously.

33. The bed frame according to claim 20, wherein the left longitudinal support bar, the right longitudinal support bar and the intermediate longitudinal support bar respectively comprise two main body sections and an intermediate section connected between the two main body sections, the main body sections and the intermediate section are connected via a connecting sheet, a support bar pivot shaft is mounted on the connecting sheet, the two main body sections are configured to be capable of rotating relative to each other about their respective support bar pivot shafts in a vertical plane relative to the intermediate section so that the bed frame is folded or unfolded in the vertical plane.

34. The bed frame according to claim 20, wherein the connecting rod comprises a plurality of bushing rods which are nested one inside another so that the connecting rod is telescopic.

35. The bed frame according to claim 34, wherein in any two adjacent bushing rods, a first bushing rod is provided with a first alignment hole, a bulb leaf spring with a protrusion is disposed in the first alignment hole, the bulb leaf spring is configured to extend out of the first alignment hole under action of an elastic force and retract back into the first alignment hole when subjected to a pressure, and a second bushing rod is nested around the first bushing rod, a second alignment hole is disposed on a side face of the second bushing rod facing the first alignment hole, the second alignment hole is configured in a way that when the second alignment hole aligns with the protrusion, the protrusion can extend out under the action of elasticity, automatically enter the second alignment hole and thereby lock the two adjacent bushing rods relative to one another.

36. The bed frame according to claim 20, wherein the bed frame is configured to be engageable with a tongue member for mounting a bedhead member, the tongue member comprises a tongue, an upwardly open slot is provided at the end of the left longitudinal support bar and right longitudinal support bar, and the slot is configured to receive the tongue.

37. The bed frame according to claim 20, wherein the left longitudinal support bar, the right longitudinal support bar, and the intermediate longitudinal support bar are respectively provided with downwardly extending legs at both ends and in the middle.

38. The bed frame according to claim 37, wherein the legs are also pivotally connected to respective longitudinal support bars, the legs are rotatable and foldable relative to the respective longitudinal support bars, and in the folded state the legs abut against the respective longitudinal support bars side by side.

39. A bed frame, comprising:

a left longitudinal support bar and a right longitudinal support bar;

an intermediate longitudinal support bar between the left longitudinal support bar and the right longitudinal support bar;

a first sleeve having a first bracket and a second sleeve having a second bracket, the first and second sleeves slidable on the intermediate longitudinal support bar;

a first end of a first left connecting rod pivotally attached to the first bracket, and a second end of the first left connecting rod pivotally attached to the left longitudinal support bar;

a first end of a second left connecting rod pivotally attached to the second bracket, and a second end of the second left connecting rod pivotally attached to the left longitudinal support bar;

a first end of a first right connecting rod pivotally attached to the first bracket, and a second end of the first right connecting rod pivotally attached to the right longitudinal support bar;

a first end of a second right connecting rod pivotally attached to the second bracket, and a second end of the second right connecting rod pivotally attached to the right longitudinal support bar;

wherein the first end of the first left connecting rod and the first end of the first right connecting rod move with the first sleeve, and the first end of the second left connecting rod and the first end of the second right connecting rod move with the second sleeve, when the first and second sleeves slide along the intermediate longitudinal support bar, with each connecting rod moving in a horizontal plane, to move the bed frame into an unfolded, folded or partially folded position;

first and second end pin holes in the intermediate longitudinal support bar adjacent to first and second ends of the intermediate longitudinal support bar;

first and second middle pin holes in the intermediate longitudinal support bar adjacent a middle portion of the intermediate longitudinal support bar;

a first partial position pin hole in the intermediate longitudinal support bar between the first end pin hole and the first middle pin hole;

a second partial position pin hole in the intermediate longitudinal support bar between the second end pin hole and the second middle pin hole;

a first end pin in the first end pin hole, a first middle pin in the first middle pin hole, and a first partial pin in the first partial position pin hole;

a second end pin in the second end pin hole, a second middle pin in the second middle pin hole, and a second partial position pin in the second partial position pin hole;

a first receiving hole in the first sleeve and a second receiving hole in the second sleeve, the first end pin, the first middle pin, and the first partial position pin configured to extend into the first receiving hole via spring force, and the second end pin, the second middle pin, and the second partial position pin configured to extend into the second receiving hole via spring force, to prevent movement of the sleeves on the intermediate longitudinal support bar;

the connecting rods perpendicular to the intermediate longitudinal support bar when the first end pin is in the first receiving hole and the second end pin is in the second receiving hole;

the connecting rods parallel to the intermediate longitudinal support bar when first middle pin is in the first receiving hole and the second middle pin is in the second receiving hole; and the connecting rods at an acute angle to the intermediate longitudinal support bar when the first partial position pin is in the first receiving hole and the second partial position pin is the second receiving hole, and the bed frame having a width of a twin size bed.

* * * * *